United States Patent [19]

Hopper

[11] 4,386,454

[45] Jun. 7, 1983

[54] APPARATUS FOR ASSEMBLING A SHADE DEVICE

[76] Inventor: Thomas P. Hopper, Blue Hills Rd., Durham, Conn. 06422

[21] Appl. No.: 170,789

[22] Filed: Jul. 21, 1980

[51] Int. Cl.[3] ..... B65H 37/00; B65H 37/04

[52] U.S. Cl. ..... 29/33 K; 29/33 R; 29/564.8; 156/65; 156/265; 156/552

[58] Field of Search ..... 156/65, 292, 265, 250, 156/552; 29/24.5, 33 K, 33 R, 564.1, 564.2, 564.6, 564.8; 219/10.81, 10.53; 160/107, 121 R; 83/500, 614

[56] References Cited

U.S. PATENT DOCUMENTS

| | | | |
|---|---|---|---|
| 976,949 | 11/1910 | Tucker | 29/33 |
| 2,321,055 | 8/1940 | Warp | 29/33 |
| 3,384,519 | 5/1968 | Froget | 156/552 |
| 3,779,121 | 12/1973 | Lagain | 83/614 |
| 3,996,828 | 12/1976 | Granger et al. | 83/500 |

*Primary Examiner*—William R. Briggs
*Assistant Examiner*—Jerry Kearns
*Attorney, Agent, or Firm*—Fitzpatrick, Cella, Harper & Scinto

[57] ABSTRACT

An apparatus is disclosed for assembling, on a mass production basis, shade devices for insulating a building area against heat transmission. Each shade device includes a roller, a plurality of shade sheets attached to the roller to be retracted thereon and detracted therefrom and a plurality of spacer devices mounted with one sheet of each pair of adjacent sheets to space them apart when detracted from the roller. The assembling apparatus comprises a sheet feeding section for ultimately feeding and assembling all of the sheets in generally mutually parallel relation. Other mechanisms place spacer devices in close proximity to each of the sheets on which spacer devices are to be mounted and attachment apparatus associated with the sheet feeding section and spacer device placing mechanisms attach each of the spacer devices to its respective closely proximate sheet. A further mechanism is provided to secure a leading lateral edge of each of the sheets to the roller and to rotate the roller to retract all of the sheets and spacer devices thereon.

52 Claims, 17 Drawing Figures

16
130d
130c
130b
130a
136b
136a
136c
61d
61c
61b
61a
58c
58b
58a
P1
56
47
18
86
222
224
216
218
227
220
210
20
D
S
226
62c
62b
62a
60
66
68
134

Fig. 6.
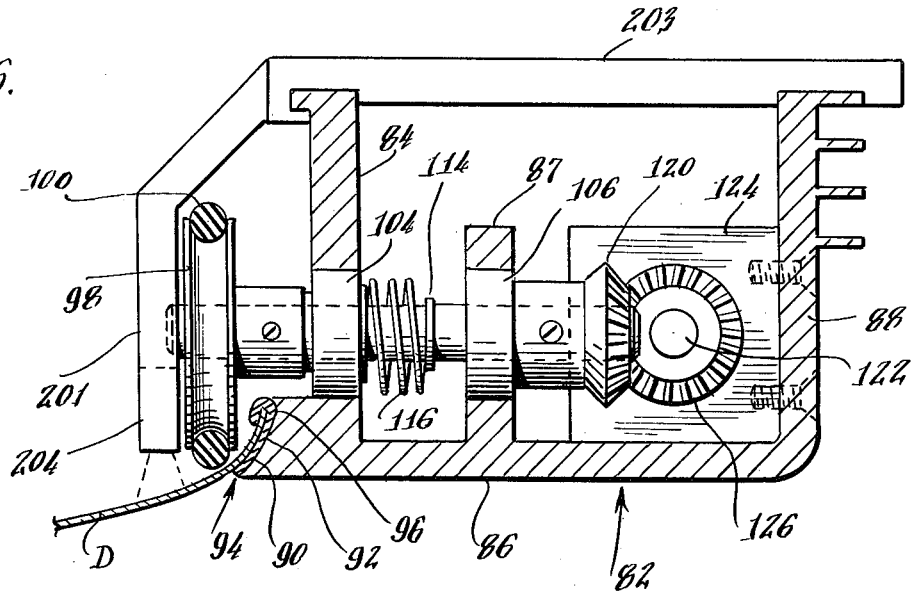
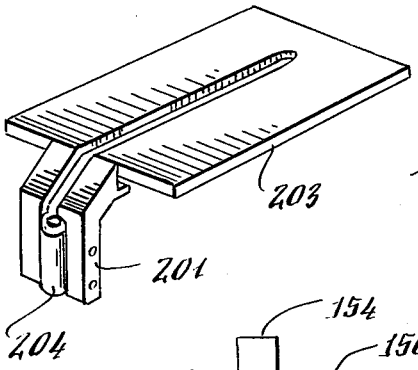
Fig. 8.
Fig. 7.
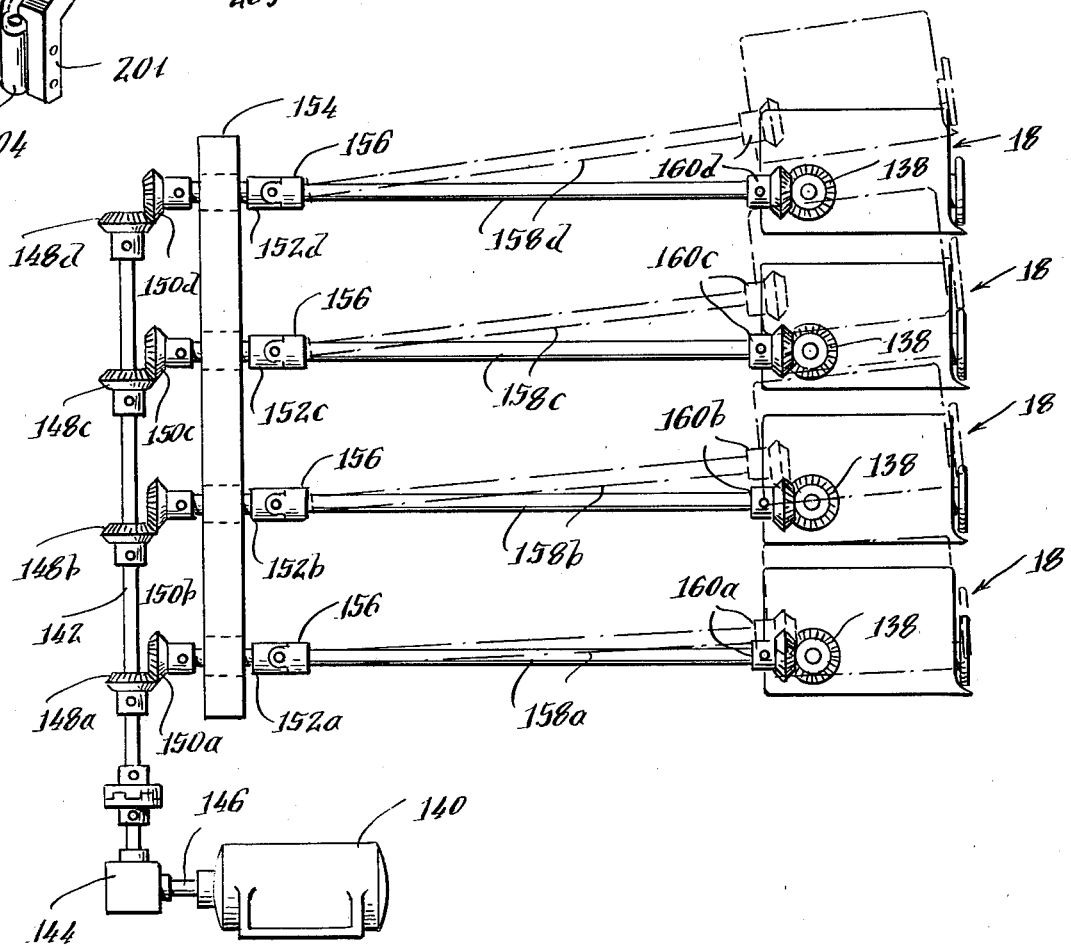

APPARATUS FOR ASSEMBLING A SHADE DEVICE

BACKGROUND OF THE INVENTION

1. Field of the Invention

The present invention relates to apparatus for assembling shade devices for insulating a building area such as a window or wall against heat transmission. More specifically, the apparatus relates to apparatus for assembling a shade device such as that described in U.S. Pat. Nos. 4,039,019 (Hopper) and 4,194,550 (Hopper) in an efficient economical way on a mass production basis.

Great concern has arisen in recent years for the increased and inefficient use of energy. Such use is particularly troublesome because most energy presently is derived from finite fossil fuels. Accordingly, proposals have been made to more efficiently use energy through conservation. One such proposal is for a multilayer insulating window shade device that significantly reduces the transmission of radiant, convective, and conductive heat through building areas such as windows. This device is described in U.S. Pat. Nos. 4,039,019 and 4,194,550, both granted to the applicant here and includes a plurality of shade sheets attached to a roller to be retracted thereon and detracted therefrom. The sheets are provided with a surface having a low emittance. Spacer devices are mounted with one sheet of each pair of adjacent sheets to space them apart when detracted from the roller. Each spacer device comprises an elongated strip of sheet material having a major axis and a normally arcuate cross-sectional shape curved about the major axis. When the multilayer shade device is drawn from the roller to cover the building area to be insulated, adjacent sheets are therefore spaced apart to define dead air spaces. These dead air spaces, in combination with the low surface emittance provided by the surfaces of the individual shade sheets, yield a synergistic insulating effect to resist radiant, conductive, and convective heat transmission. That is the insulating valve of the drawn shade substantially exceeds the sum of the insulating valves of a single sheet having a low emittance surface and of a spaced pair of sheets neither of which has a low emittance surface.

Because the shade device does not itself supply energy, it may be considered a passive energy conservation device. In winter months during periods of high transmission of heat energy inwardly through a window, the shade may be retracted onto its roller to allow the interior of the building to be warmed by available sunlight. However, when unwanted heat transmission occurs outwardly through the window, the shade may be drawn to minimize such waste. Conversely, in summer months the shade may be drawn during the day to limit heat transmission into a building area and opened at night to allow unwanted heat to escape. Therefore, this multilayer insulating window shade device provides highly desirable results in conservation of limited fuels used for space heating and cooling.

2. Description of the Prior Art

Various proposals have been made for assembling insulating shade devices such as those described above. For example, in the past, a single sheet has been spread on a table and a single spacer device has been temporarily mounted thereon. Typically, the material from which the shade sheet and spacer device are made are heat weldable. Therefore, the sheet and spacer device were feed to a single pair of reciprocally mounted heat welding bars that clamp and heat weld one edge of the spacer device to the single sheet so that the opposite longitudinal edge of the spacer device curves away from and is spaced from the sheet. This process is repeated until a sufficient number of spacer devices have been mounted on the single sheet. A second sheet is then assembled in the same way and is in turn assembled with the first completed sheet. This process is continued until a shade device has been assembled with as many sheets as desired. The multiple sheets may then be secured to a roller to be retracted thereon.

It is apparent that the procedure for assembling the shade device described above is time consuming and therefore inefficient and uneconomical. Accordingly, it is desirable to provide for automatic assembly of the various components of the shade device.

Other proposals have been made for assembling various complicated devices somewhat similar to the shade device described above. For example, U.S. Pat. No. 3,384,519 (Froget), discloses a method and machine for producing a continuous cloth comprising a series of strips secured between spaced vertical sheets. The machine includes heat welding units for securing each strip at its edge to one of the vertical sheets. Another embodiment of the machine includes two heat welding devices for securing both edges of the strip to opposing vertical sheets. The machine also includes two laterally movable clamps that pull the strip laterally into position adjacent an intermittently advancing sheet forming one of the vertical sheets.

U.S. Pat. No. 2,895,534 (Steidinger), discloses a mechanism for adhering gummed tape to the top flaps of envelopes. The tape is advanced by a single pair of drive rollers that impart a fold along the tape to give it some rigidity. The tape is held in position to be heat welded to the envelope flap by spaced vertically arranged guides which are retractable below the bottom pressure receiving surface of a heat welding device.

U.S. Pat. No. 2,714,413 (Hunter et al) discloses a method and apparatus for making plastic venetian blind ladders in which the plastic ladder tape is formed on a continuously advancing stainless steel belt. The tape is reinforced with threads of filaments, each fed from one cone in a series over an idler roller arranged in a vertical array of idler rollers. The respective top and bottom tapes are fed into spaced parallel relation and the blind support pieces are fused therebetween.

SUMMARY OF THE INVENTION

In its preferred embodiment, the apparatus of the present invention applies mass production techniques to the assembly of an insulating window shade device described above. Accordingly, the device may be manufactured rapidly, inexpensively and, therefore, brought to greatest utilization in the shortest period of time by large numbers of people. This is particularly significant because of the energy saving attributes of the device being constructed.

In the preferred embodiment, the apparatus for assembling the insulating shade device described above, includes a sheet feeding assembly for simultaneously longitudinally feeding the shade sheets in generally mutually parallel spaced relation. A mechanism for feeding an arcuate spacer device laterally across each of the sheets and for holding it in close proximity thereto, is mounted adjacent each of the sheets within the sheet feeding assembly.

Mounted with each spacer device feeding mechanism in the main sheet feeding apparatus is a device for attaching the spacer devices to the respective, closely proximity sheet. In the preferred embodiment, these attaching devices comprise one pair of heat welding bars for each of the sheets to which the spacer devices are to be attached. Each pair of heat welding bars is mounted to be spaced apart in an open position, simultaneously with all other pairs of bars, permitting a sheet and spacer devices to pass therebetween. Similarly, each pair of heat welding bars is mounted to be moved simultaneously with all other pairs to a closed position clamping and heat welding one longitudinal edge of the spacer device to the closely proximate sheet.

After all sheets are assembled with an appropriate number of spacer devices attached to each, all are fed to a nip roller assembly where they are compressed together and fed to the shade device retracting roller. A gang of staplers is arranged to drive staples through a leading lateral edge of each of the assembled sheets to attach them to the retracting roller. The roller is then rotated by a drive mechanism to retract the assembled sheets and spacer devices thereon.

A shuttle cutting device cuts all of the sheets simultaneously to define trailing lateral edges spaced from the leading lateral edges of the shade sheets.

In other preferred embodiments of the present invention, principles of assembling the various components of the insulating shade device are applied to achieve mass production efficiencies. For example, in one such embodiment a single sheet of material is fed from a supply roll preferably having width at least equal to the final length of a shade sheet by a sheet feeding assembly. A plurality of spacer devices are fed by a spacer device feeding mechanism simultaneously and at the same linear rate into close proximity with the advancing sheet and one edge of each is simultaneously attached by, for example, a sonic welding apparatus to the sheet. After spacer devices have been attached to a length of sheet material equal to a suitable width for the final shade sheet, the sheet material and spacer devices are cut to this width. The assembled sheets are then stacked one on top of the other until enough have been put together to form a shade device. The stacked sheets are then attached to a roller by a gang of staplers as described above.

Each of the assemblies and mechanisms, for performing each of the functions described above with reference to the preferred embodiments of the invention, incorporates novel features that enhance the efficiency and economy achieved by the apparatus of this invention for assembling insulating shade devices.

Accordingly, it is an object of the present invention to provide an apparatus for assembling a multilayer insulating shade device in an efficient, economical and, therefore, desirable manner.

It is a further object of the present invention to provide an apparatus by which insulating shade devices may be manufactured in such a manner that they may be widely used for the efficient conservation of energy.

It is a further object of the present invention to provide specific novel mechanisms for performing various functions in the process for assembling multilayer shade devices described above.

These and other objects of the present invention will be pointed out in and will be understood from the following detailed description provided below in conjunction with the accompanying drawings.

BRIEF DESCRIPTION OF THE DRAWINGS

FIG. 6 is an enlarged vertical cross-sectional view, taken on plane 6—6 in FIG. 5, of this spacer device feeding mechanism.

FIG. 7 is a side elevational view illustrating an arrangement for supplying motive power to each of the mechanisms for feeding spacer devices into close proximity with each shade sheet.

FIG. 8 is an enlarged perspective view of a sensor device for sensing the location of a spacer device as feed through the feeding mechanism.

DETAILED DESCRIPTION OF THE PREFERRED EMBODIMENT

A. Introduction

Figure 1:
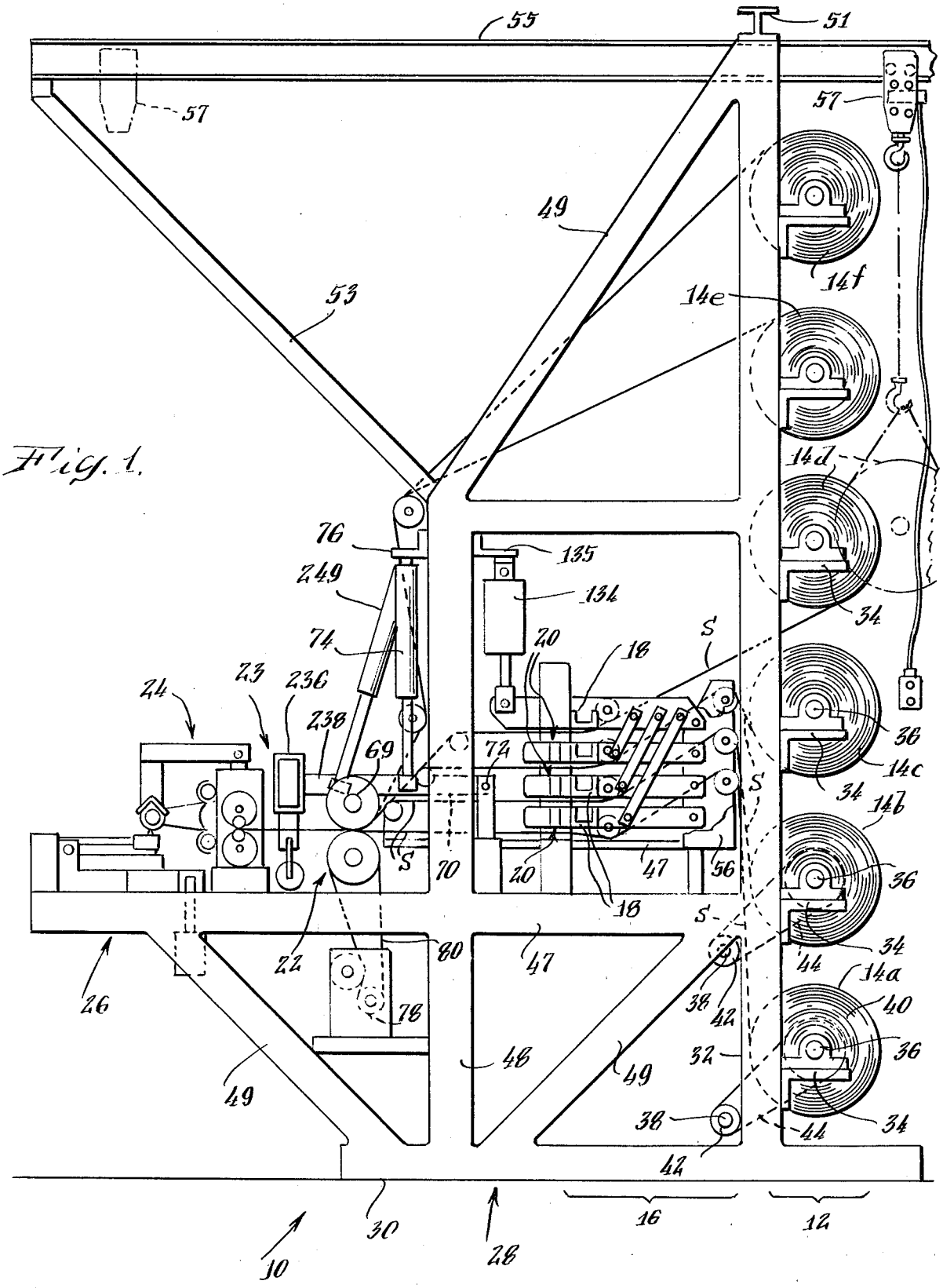
FIG. 1 is a side elevational view of a first embodiment of the apparatus of the present invention for assembling multilayer insulating shade devices.

The apparatus of the present invention is specifically designed for assembling a shade device for insulating a building area such as a window or wall against conductive, convective, and radiant heat transmission, such as that described in U.S. Pat. Nos. 4,039,019 (Hopper) and 4,194,550 (Hopper). The apparatus of the present invention is adapted to assemble such shade devices in an efficient manner employing methods of mass production so that the shade devices may economically be put into wide use.

As described in U.S. Pat. No. 4,039,019 (Hopper), the insulating shade device includes a plurality of nontransparent shade sheets that are attached to a retracting device, specifically a roller. The sheets may be retracted onto the roller for storage or detracted therefrom to cover the building area to be insulated. A number of resilient spacer devices in the form of arcuate strips are mounted within the shade apparatus to separate each pair of adjacent sheets and thereby define a dead air space therebetween. In one preferred embodiment of the shade device, each spacer device is an elongated, elastic, tapelike strip permanently formed to assume a partially cylindrical arcuate shape having an axis parallel to the major axis of the strip. Both the shade sheets and the spacer devices are made of heat weldable material or, at least, are provided with a heat weldable coating on their surfaces. The shade sheets may be constructed in accordance with the disclosure of U.S. Pat. No. 4,247,599 (Hopper). One lateral edge of the spacer device, extending in the direction of the major axis, is secured to the shade sheet so that the opposing lateral edge of the spacer device curves away and is spaced from the sheet. Accordingly, each spacer device serves to space the shade sheet to which it is attached away from an adjacent shade sheet. A number of spacer devices are attached to each of the shade sheets to insure proper spacing between adjacent sheets.

Each shade sheet is provided with a surface that has a low surface emittance. The combination of this low surface emittance with the dead air space defined between adjacent sheets provides a synergistic multiplication of insulating valve that exceeds that provided by either the low emittance sheet surface or the dead air space alone.

In the first embodiment, shown in detail in FIGS. 1 through 14, the apparatus of the present invention simultaneously feeds a plurality of shade sheets in a longitudinal direction, simultaneously feeds one spacer device into close proximity to each sheet and thereafter attaches the closely proximate spacer device to each of the shade sheets. The apparatus is capable of repeatedly operating so that all spacer devices necessary for the fully assembled shade device are included therein. The apparatus further trims the longitudinal edges of the shade sheets and spacer devices and laterally cuts all sheets to define a trailing lateral edge thereof. The sheets are secured to a retracting device such as a roller and ultimately wound on the roller for subsequent manufacturing operations.

Referring now specifically to FIG. 1, which shows the overall construction of the first embodiment, the apparatus of the present invention is generally indicated at 10 and includes a first section, generally indicated at 12, in which a plurality of essentially endless supplies or rolls 14 of shade sheet material are stored.

The apparatus further includes an assembly 16 for feeding each of the shade sheets from a supply 14 into mutually parallel spaced relation.

Mounted with the sheet feeding assembly are a plurality of mechanisms, each of which is generally indicated at 18 and is designed to feed a spacer device into close proximity to one of the shade sheets fed through the sheet feeding assembly.

Devices, each generally indicated at 20, for attaching each of the spacer devices to the sheet into close proximity with which it has been fed are also mounted with the sheet feeding subassembly.

The sheet feeding assembly 16 is designed for shifting reciprocal movement between open and closed positions. In the open position, shade spacer devices may be fed into close proximity with an adjacent sheet and the shade sheets and spacer devices may be fed through the sheet feeding assembly. In the closed position, spacer devices are clamped and attached to the shade sheet into close proximity with which they have been fed.

The apparatus of the invention further includes a mechanism, generally indicated at 22 for compressing the assembled sheets and spacer devices together and for supplying motive power to the sheets to drive them through the apparatus of the invention. The sheets and spacer devices are again compressed by a mechanism 23 that also laterally cuts all sheets simultaneously.

The apparatus of the invention may incorporate a sizing or trimming mechanism generally indicated at 24 for trimming longitudinal edges of the sheets to a desired width. The apparatus of the invention additionally includes a stage generally shown at 26 for attaching leading lateral edges of each of the assembled shade sheets to a retracting roller and for rolling the assembled sheets and attached spacer devices onto the roller for subsequent operations for ultimate shipment and storage.

Generally the shade sheets are advanced through the apparatus. Simultaneously spacer devices are fed laterally across the sheets. Then the advance of the sheets is stopped and each spacer device is attached to its closely proximate sheet. Advance of the sheets and simultaneous lateral feeding of spacer devices begins again and continues until the sheets are again positioned to receive spacer devices. At this time the sheets are again stopped and the spacer devices attached thereto. This process continues until the desired number of spacer devices have been attached to the sheets.

Advance of the sheets also stops for the lateral cutting operation and the operation attaching all sheets to the retracting roller.

Each of the assemblies, mechanisms, devices and stages of the apparatus of the invention for performing various operations on the components of the insulating device will be described in greater detail below.

As can be seen in FIG. 1, each of the sections of the apparatus for performing various operations on the components of the insulating shade device is mounted on a frame structure generally indicated at 28, which may be made of steel box beams welded into the configuration shown. Of course, FIG. 1 shows only one side of this frame structure 28. Specifically, the frame structure includes a base 30 from which two main rear beams 32 upwardly project in vertically spaced, parallel relation. Again, it will be understood that FIG. 1 shows only one of these beams. A series of L-shaped brackets 34 span the distance between the beams 32 and support shafts 36 thereon. Each shaft is nonrotatable and is adapted to carry an essentially endless supply 14 of rolled sheet material on bearings (not shown). Each shaft is adjustable in vertical and horizontal directions so that all shafts may be made parallel. In the preferred embodiment, provision is made for support of six supply rolls.

As can further be seen in FIG. 1, one fixed shaft 38 is horizontally cantilevered from one of the vertical beams 32 below each L-shaped bracket 34. The shafts 36 are provided with pulleys 40 and each shaft 38 is provided with a fixed pulley 42 positioned in alignment with one pulley 40. A friction band such as rubber O-ring 44 is reaved about the pulleys 40 and 42. The shaft 38 and pulley 42 mounted thereon are held in non-rotatable relation on the vertical beam 32. Accordingly, the drag created by the non-rotatable pulley 42 on the O-ring and in turn on the pulley 40 mounted with each shaft 36 prevents unwanted inertial rotation of the supplies and prevents accidental paying of sheet material from the supplies. The O-ring also causes the shaft 36 to rotate backward slightly when paying of sheet material from the associate supply stops. Therefore, a slight tension on the sheet material is maintained.

The frame structure 28 further includes two intermediate support beams 48 that project vertically upwardly from the base 30 and platform beams 46 that extend horizontally between the vertical support beams 32 and 48 and are cantilevered forwardly beyond the beams 48 and pairs of lower, obliquely extending stiffening beams 49. The tops of the rear vertical support beams 32 are joined to the tops of the intermediate vertical support beams 48 by similar obliquely extending stiffening beams 49. In addition, a single beam 51 spans the distance between the tops of the rear vertical beams 32. A pair of beams 53 extend from the apices of the intermediate vertical beams 48 and stiffening beams 49 and are joined at their tops to define a triangular shape. A single beam 55 extends longitudinally between the beam 51 and the tops of the beams 53 and carries a traveling hoist 57 that may be used to lift the supply rolls 14 of sheet material into position or to remove any of the components of the apparatus from the platform beams 46 for repair, for example.

Each of the mechanisms of the apparatus, including the sheet feeding assembly 16, the spacer feeding mechanisms 18, the spacer attaching devices 20, sheet compressing mechanism 22, the cutting mechanism and trimmer mechanisms 23 and 24 and the stapler stage 26, are mounted on the platform beams 46.

Each of the mechanisms of the apparatus of the present invention will now be described in detail with reference to the remaining figures.

B. The Sheet Feeding Assembly

Figure 2:
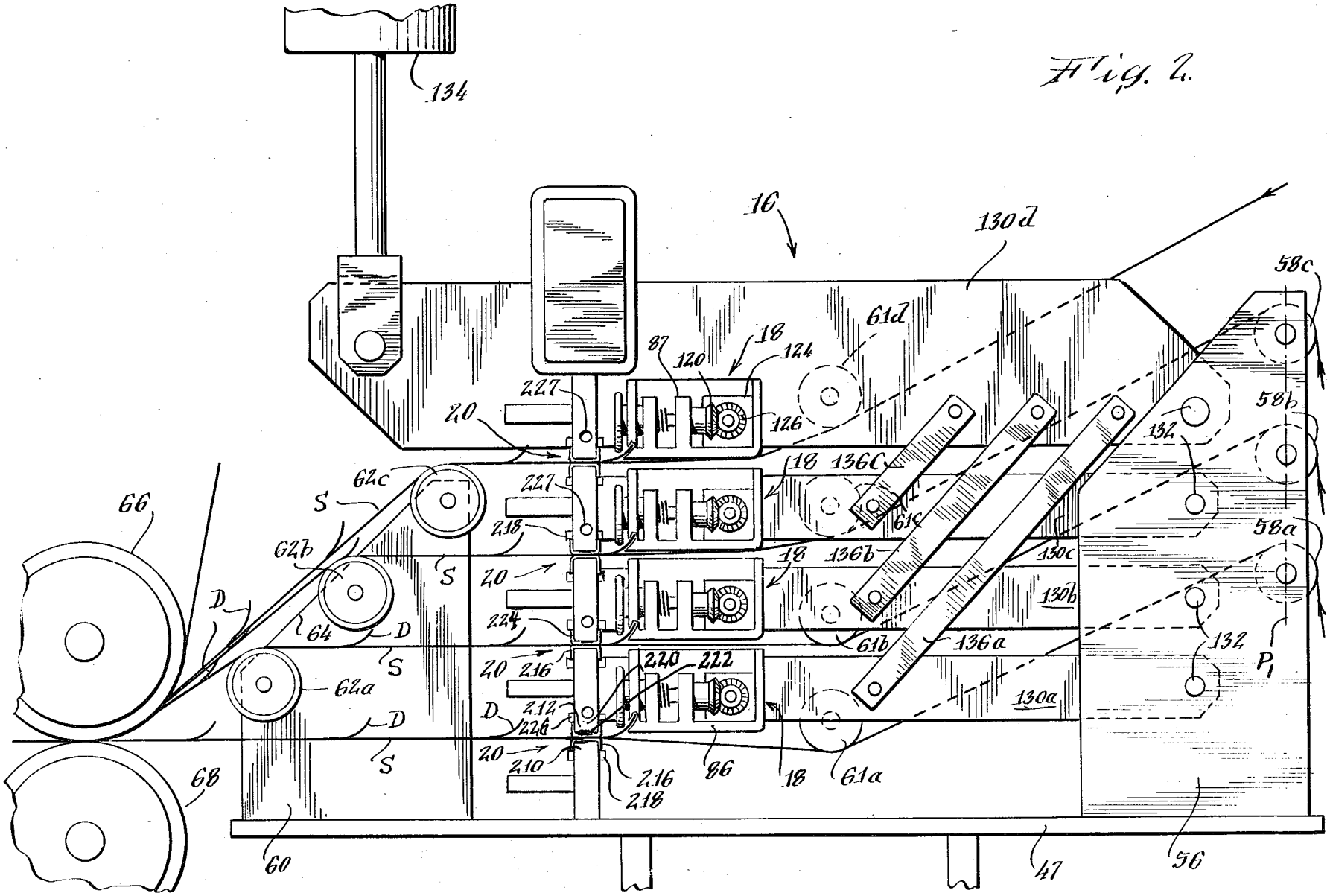
FIG. 2 is an enlarged side elevational view of a portion of this first embodiment that is particularly useful in describing the sheet feeding assembly for feeding shade sheets in generally mutually parallel spaced relation, the spacer device feeding mechanisms for feeding spacer devices into close proximity to each shade sheet, and the spacer device attachment devices for attaching the spacer devices to the sheets.
Figure 3:
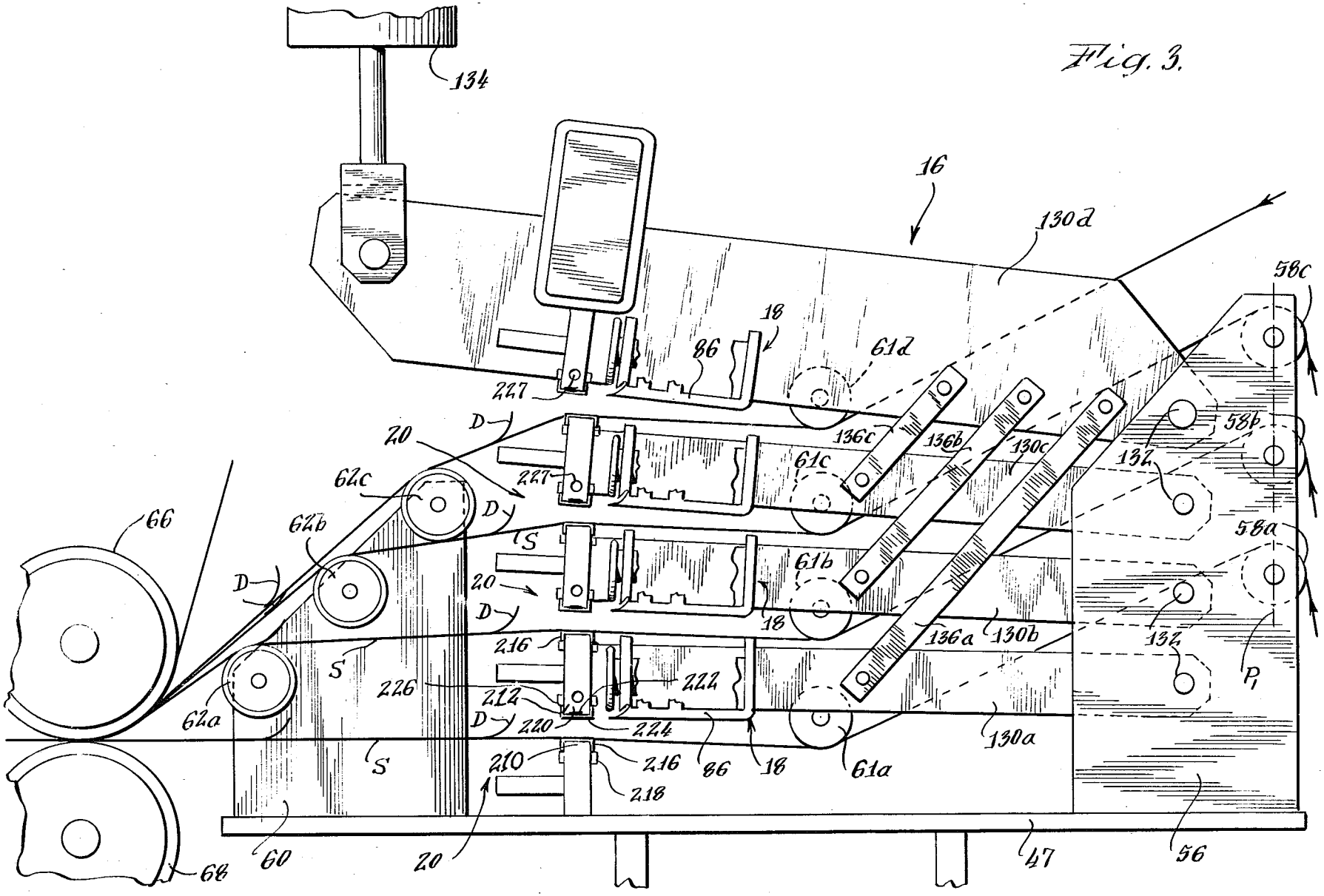
FIG. 3 is an enlarged cross side elevational view similar to that shown in FIG. 2 but with the devices for attaching spacer devices to shades and the mechanisms for feeding spacer devices into close proximity to each sheet moved to an open position permitting the sheets and spacer devices to pass through the sheet feeding assembly.

FIGS. 2 and 3 illustrate the sheet feeding assembly 16, in detail. This assembly includes a pair of vertically extending end support plates 56 projecting upwardly from a base 47, which in turn rests on the platform beams 46, and forwardly from the rear vertical beams 32. A plurality of inlet idler rollers 58 are mounted in spaced mutually parallel relation for free rotation between the end support plates 56. The lower-most roller 58*a* is adapted to guide the sheet material from the lowermost supply 14*a* into the sheet feeding assembly 16. Each successive inlet idler roller 58 *b* through *d*, guides a successive sheet from the corresponding supply mounted in a successively higher position relative to the rear vertical beams 32. And as can be seen in FIGS. 1 and 2, sheet material is fed from the bottom of supplies 14*a*, 14*b* and 14*c*, over the tops of inlet idler rollers 58*a*, 58*b* and 58*c*.

The axes of the inlet idler rollers 58 define a common plane $P_1$ that extends generally perpendicularly to the support beams 46 and to the planes of the shade sheets as fed through the assembly 16 as will be described in greater detail below.

The assembly 16 further includes two spaced forward support plates 60 that project upwardly from the support base 47. A plurality of outlet idler rolls 62 are mounted in mutually parallel, spaced relation on the upper edges 64 of the plates 60, which extend obliquely to the support base 47. Each outlet idler roll 62 is spaced from and extends in generally mutually parallel relation to one inlet idler roller. For example, outlet idler roller 62*a* is spaced from inlet idler roller 58*b* and together therewith defines an idler roller pair for guiding one shade sheet therebetween. Inlet and outlet idler roller pair 62*b*–58*c* is similar to the pair 62*a*–58*b*. Thus, as can be seen in FIGS. 1, 2 and 3, the shade sheets are guided through the sheet feeding assembly in generally parallel spaced relation so that various assembly operations may be performed thereon.

As can be seen in FIGS. 2 and 3 each sheet S is also guided over a device for smoothing the sheet from edge to edge. In the preferred embodiment, each such device is a spreader roll 61 such as a bow or herringbone roll mounted in a manner described below and each sheet S extends below one such roll on its path between the inlet and outlet idler rollers.

The sheet feeding assembly 16 also includes a pair of nip rollers 66 and 68, at least one of which is driven. All shade sheets pass between the nip rollers which accordingly define a sheet drive for drawing all sheets through the sheet feeding mechanism. As can be seen in FIG. 1, the upper nip roller 66 is carried on a shaft 69 extending between a pair of pivot arms 70 mounted for pivoted movement on a pivot pin 72 toward and away from the lower nip roller 68. At least one pressurized gas driven piston and cylinder assembly 74 is mounted between the pivot arms 70 and an L-shaped bracket 76 secured to the intermediate vertical beams 48. The piston and cylinder assembly is double acting. That is, pressure may be applied to urge the upper nip roller 66 into engagement with the lower nip roller 68 to insure that the shade sheets are tightly compressed therebetween and therefore positively driven. The piston and cylinder assembly may also be actuated to move the upper nip roller 66 away from the lower nip roller 68 to release the shade sheets. In the preferred embodiment, the lower nip roller is driven by a motor through transmission 78 mounted below the platform 46 on the frame structure 28. It is connected to the lower nip roller by a drive belt, chain, or similar device 80.

As can be seen in FIGS. 1, 2 and 3, the axes of the outlet idler rollers 62 define a plane that extends obliquely to the base 47 and the planes defined by the shade sheets fed between the inlet and outlet idler rollers. Accordingly, each outlet idler roller guides one shade sheet to the nip rollers 66 and 68 over a path of length longer than that for one adjacent sheet and shorter than that for an opposite adjacent sheet. This structural relationship has importance which will be explained in greater detail below.

C. The Spacer Device Feeding Mechanisms

Figures 9, 10:
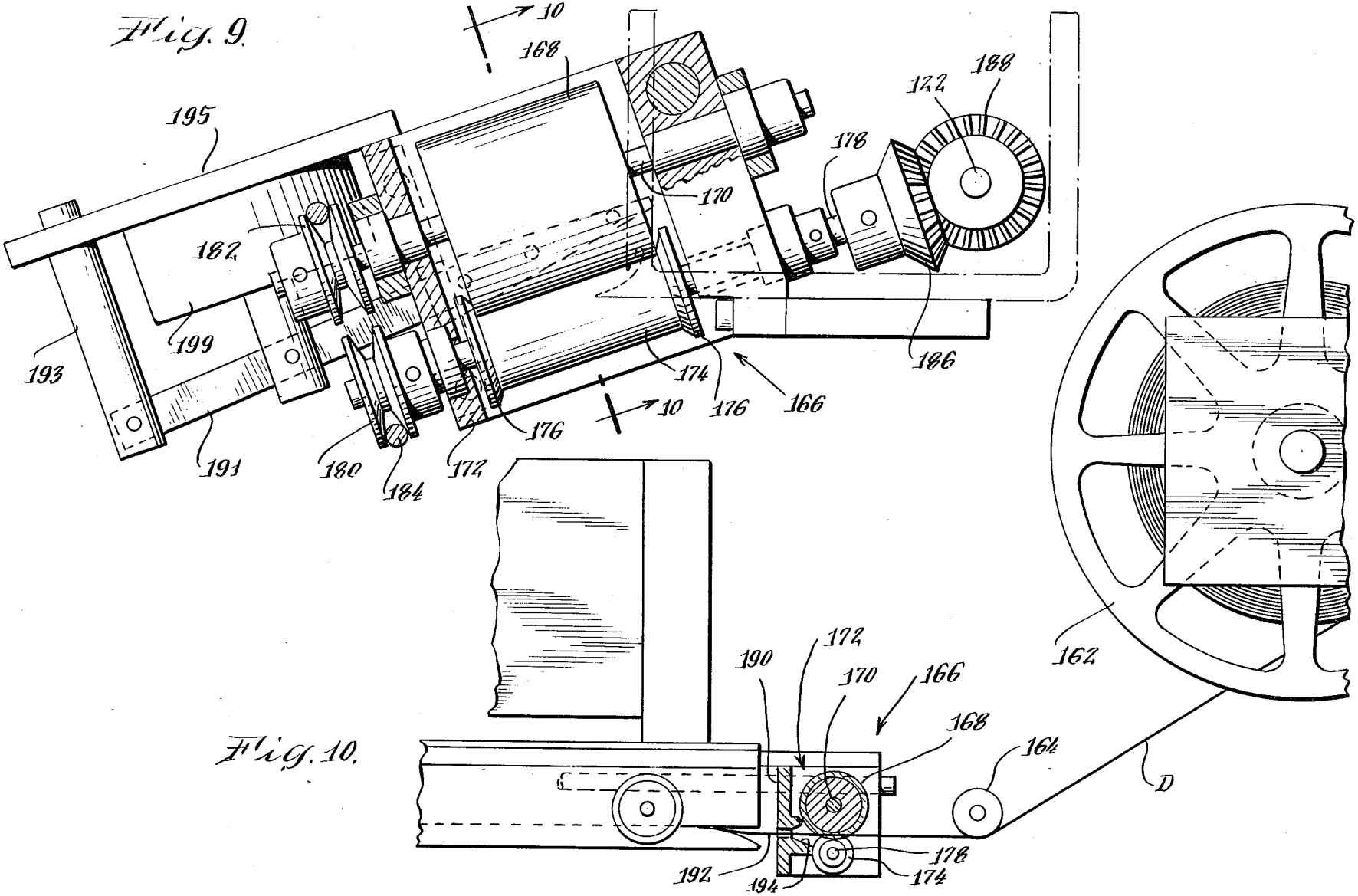
FIG. 9 is an end view, partly in cross-section, of a device for delivering spacer devices from an essentially endless supply to the feeding mechanism.
FIG. 10 is a reduced scale front view, shown partly in cross-section, taken on plane 10—10 in FIG. 9 showing the device for delivering a spacer device from a supply.

The apparatus of the invention also includes a plurality of mechanisms for feeding an arcuate spacer device into close proximity with each of the shade sheets fed through the sheet feeding mechanism. These spacer device feeding mechanisms are shown in FIGS. 2 and 3 and in detail in FIGS. 4, 5 and 6. Apparatus for delivering spacer devices from essentially endless supplies to the feeding mechanisms is shown in FIGS. 9 and 10.

Figure 4:
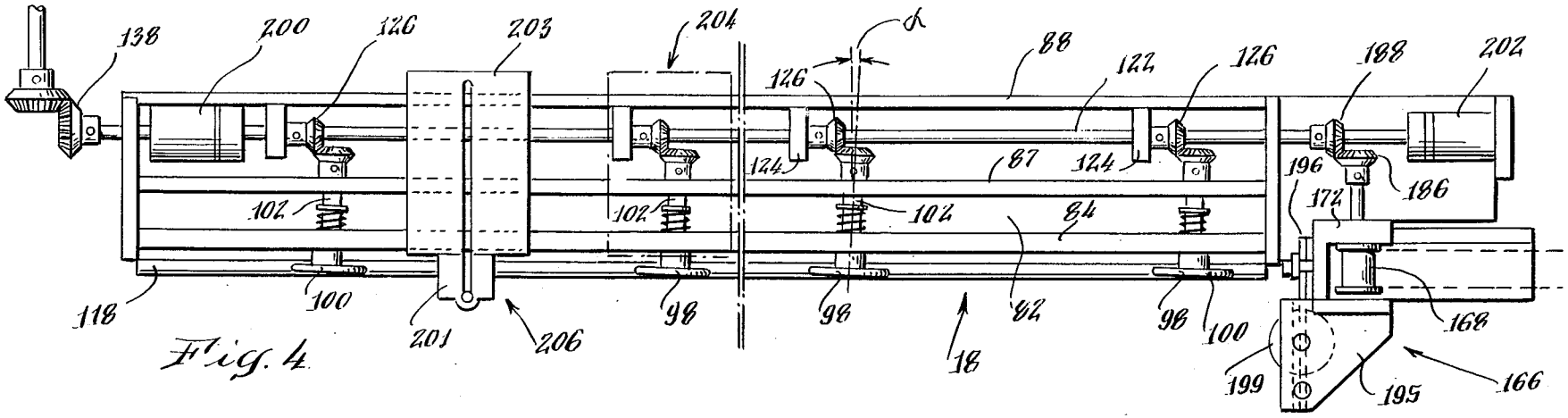
FIG. 4 is a top plan view of one mechanism for feeding spacer devices into close proximity to each shade sheet.
Figure 5:
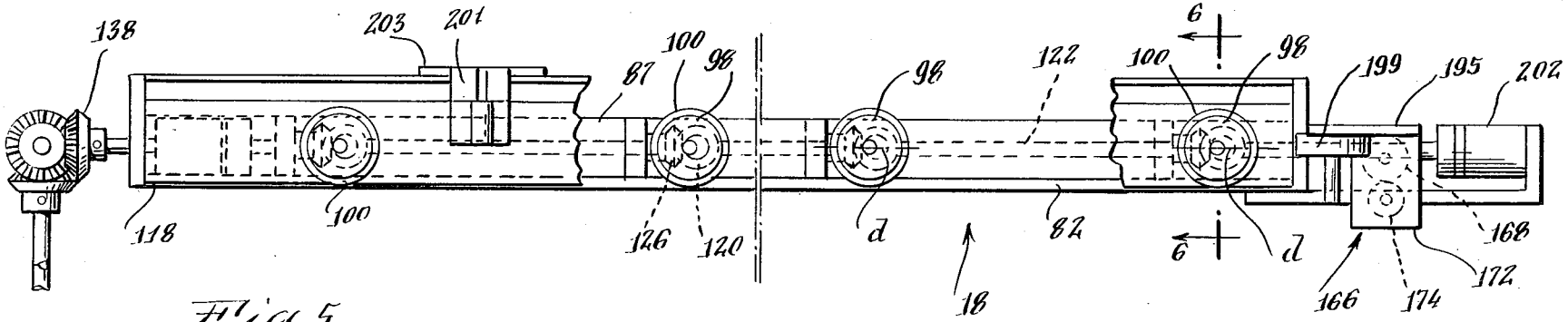
FIG. 5 is a front elevational view, partly broken away to show detail, of this spacer device feeding mechanism.

Referring first to FIGS. 4, 5 and 6, each spacer device feeding mechanism includes a generally U-shaped tray 82 that may, for example, be machined or extruded aluminum or plastic. The tray is formed with a base 86, a forward wall 84, an intermediate wall 87, and a rear wall 88. The front surface of the forward wall 84 is formed with a generally arcuate support surface 90 that may have an antifriction surface and a portion of which defines one wall 92 of a slot 94. The slot has an elongated abutment surface 96 at one end of the wall 92. As can be seen in FIG. 6, an arcuate spacer device D may be guided on the support surface 90 with one elongate lateral edge in abutting relation with abutment surface 96. As will be described in detail below, when the spacer device is positioned with its edge in contact with the abutment surface, it is precisely positioned for attachment to a shade sheet.

Each spacer device feeding mechanism includes means for advancing the spacer device laterally along the slot 94 and for pressing the spacer device against the arcuate support surface as well as urging the longitudinal edge of the device into abutting engagement with the abutment surface 96. This means includes a plurality of drive wheels 98, each of which carries a resilient O-ring 100 on its circumference. Each drive wheel 98 is carried on one end of a stub shaft 102 that projects through the forward wall 84 and is mounted on anti-friction bearings 104 and 106 mounted respectively in the forward and intermediate walls 84 and 87. The stub shaft is provided with a radially outwardly projecting removable collar 114 intermediate its ends. A coil spring 116 is compressed between the collar 114 and the anti-friction bearing 104 to urge the drive wheel to the right as seen in FIG. 6 and accordingly, to urge the resilient O-ring 100 into rotational sliding frictional engagement with the arcuate support surface 90. It will be understood that other forms of trays and drive wheels may be used. For example, a drive wheel having a tread and molded from a low durometer, resilient, rubber material would be acceptable.

As can further be seen in FIG. 4, the stub shaft 102 is mounted between the walls 84 and 87 and extends at an oblique angle $\alpha$ of about 1 to 3 degrees with respect to the slot 94. That is, a lateral diameter d of each drive wheel 98 extending in the direction of elongation of the slot, is canted slightly inwardly toward the downstream end 118 of the slot. This geometric relationship between the drive wheels as determined by the mounting of the stub shaft, causes a spacer device D driven thereby on the support surface 90 to be urged into firm contact with the support surface, with the elongate edge urged into abutment with the abutment surface of the slot. Thus, as noted above, the spacer device may be precisely positioned for subsequent attachment to the shade sheet.

Each stub shaft 102 carries a bevel gear 120 on its end opposite the end on which the drive wheel 98 is carried. Each spacer device feeding mechanism further comprises an elongate driven shaft 122 extending laterally in the U-shaped tray 82 and carried on anti-friction bearings (not shown) mounted in forwardly projecting bosses 124 secured to the back wall 88 of the tray. The driven shaft carries bevel gears 126 that mate with the bevel gears 120 so that rotation of the driven shaft 122 simultaneously rotates each stub shaft 102. The mechanism for driving each driven shaft of the respective spacer device feeding mechanisms will be described in greater detail below.

Referring now again to FIGS. 1, 2 and 3, each spacer device feeding mechanism 18 is carried on a pair of pivot arms 130 mounted for pivoted movement about pivot pins 132 projecting from respective end support plates 56.

An upper enlarged pivot arm **130*d*, wider than the remaining arms 130*a*, 130*b* and 130*c* for increased structural strength, is connected to a double acting piston and cylinder assembly 134 which is in turn connected to an L-shaped support angle 135 spanning the distance between the intermediate vertically extending beams 48. This piston and cylinder assembly may be actuated to reciprocate the upper arm 130*d* upwardly and away from the base 47. Each of the remaining pivot arms 130*a*, 130*b* and 130*c* is linked to the upper pivot arm 130*d* by a separate crank arm 136*a*, 136*b* and 136*c*, each of which extends at an oblique angle to the support base 47. Accordingly, when the upper arm 130*d* is pivoted upwardly by actuation of the piston and cylinder assembly 134, the remaining pivot arms are simultaneously lifted and pivoted upwardly by the crank arms 136. Thus, they may be moved to an open position as shown in FIG. 3 to space the spacer device feeding mechanisms apart so that the sheets and spacer devices may be freely passed out of the sheet feeding assembly of the apparatus. This pivoted movement of the pivot arms is also important for operation of other portions of the apparatus of the invention, notably, the devices 20** for attaching the spacer devices to the shade sheets as will be described in greater detail below.

The mechanism for supplying motive power to the drive wheels 98 of each of the spacer device feeding mechanisms is shown in FIGS. 4, 5 and 7, and may be described as follows. Each driven shaft 122 of the spacer device feeding mechanism carries a bevel gear 138 at one of its ends. A motor 140 for driving the spacer device feeding mechanism is mounted on the frame structure 28. The motor is linked to each of the driven shafts 122 by a gear train linkage including a vertically extending shaft 142 journaled in suitable bearings (not shown) mounted on the frame structure 28. A 90 degree take-off and transmission 144 links the shaft 146 of the motor to the vertical shaft 142. The vertical shaft carries four bevel gears **148*a* through 148*d* and each of the bevel gears 148 mates with another bevel gear 150*a* through 150*d* carried on the end of a short shaft 152*a* through 152*d* journaled for rotation in anti-friction bearings (not shown) carried in a support plate 154 projecting sidewardly from the frame structure 28. Each short shaft carries a universal joint 156 connected to a long shaft 158. A bevel gear 160 is mounted for rotation at the end of each long shaft 158 and meshes with the bevel gear 138 carried on the end of the driven shaft 122 of each spacer device feeding mechanism. Accordingly, the motor 140 supplies motive power to the drive gears through the various gears and shafts. The articulated shaft assemblies, comprising the short and long shafts and universal joints 152, 158 and 156, respectively, permit the spacer device feeding mechanisms to be pivoted by action of the piston and cylinder assembly 134, as described above and as shown in solid and phantom lines in FIG. 7**.

The apparatus for delivering spacer devices to the mechanisms for feeding the devices laterally across shade sheets supplied through the assembly 16 is illustrated in detail in FIGS. 9 and 10. In particular, the spacer devices are stored in essentially endless supplies on spools or reels 162 carried on the frame structure 28. The spacer device D is fed from the spool over an idler roller 164 to a delivery drive generally indicated at 166 and shown in detail in FIG. 10. The delivery drive includes a large driven wheel 168, which may have a resilient cover, mounted on a shaft 170 carried in a mounting bracket 172 mounted on the tray 82 to the side of each spacer device feeding mechanism. An idler spool 174 having end flanges 176 that embrace the sides of the driven wheel 168 is also mounted for free rotation on a shaft 178 journaled in the mounting bracket. Both shafts 170 and 178 carry pulleys 180 and 182 on respective projecting ends and an O-ring type belt 184 is reaved about the pulleys. At its end opposite that carrying pulley 182, the shaft 178 carries a bevel gear 186 which mates with a second bevel gear 188 carried for rotation on a driven shaft 122 (see FIG. 4). Accordingly, drive of the shaft 178 simultaneously drives the drive wheel 168 in the same direction through the inter connection of the pulleys by the O-ring belt. The idler spool 174 is then driven by contact through a spacer device with the wheel 168. Thus, an essentially endless spacer device strip may be unwound from the spool 162 by actuation of the drive wheel and spool 174 and subsequently delivered to the slot 94 in tray 82.

Figure 13:
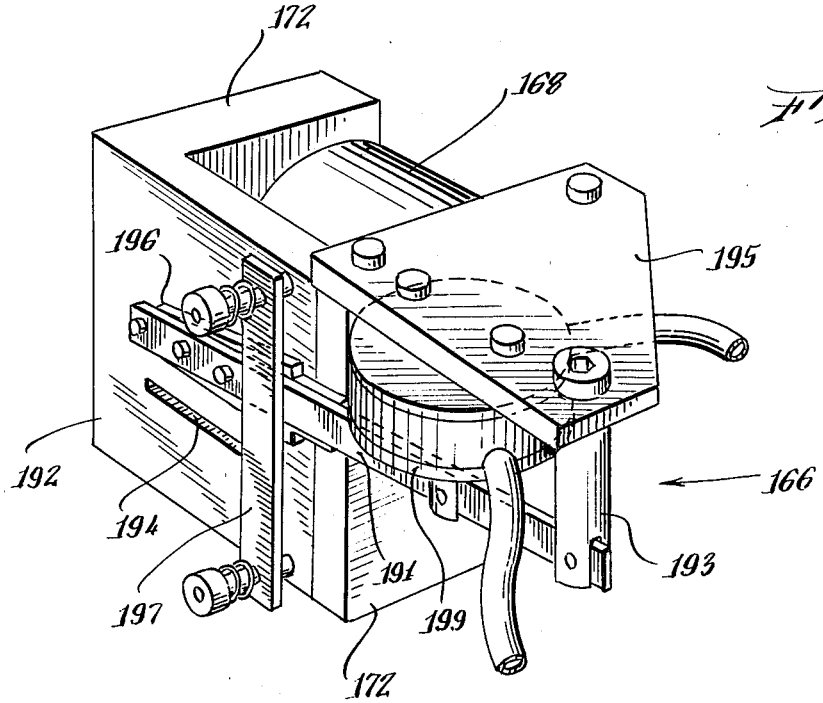
FIG. 13 is a perspective view of a mechanism for trimming spacer devices fed from the supply to appropriate width.

As shown in FIGS. 10 and 13, the mounting bracket 172 is formed with a wall 190 having a laterally directed slot 192 formed with a V-shaped inlet passage 194 at one end. The more widely open end of the inlet passage is directed toward the nip of the drive wheel 168 and idler spool 174. Accordingly, a spacer device strip is fed through the nip and guided by the V-shaped guide region into the slot 192.

As shown in FIG. 13, the front face of wall 190 is smooth. A blade 196 is mounted on a pivot arm 191 for sliding reciprocal movement on the front face of the wall 190. The pivot arm is pivoted from a lug 193 dependent from a mounting plate 195 attached to the mounting bracket 172. The blade 196 is held in tight sliding engagement with the face by a spring loaded guard 197. The pivot arm 191 is actuated by a double acting pressurized fluid driven piston and cylinder assembly 199 also mounted on the mounting plate 195. The blade 196 and slot are designed so that the spacer device may be cut by either upward or downward reciprocation of the blade. This feature saves time by permitting two cutting operations in one reciprocal cycle of the blade. This cutting operation is also done at an appropriate time as will be described below to define a spacer device of appropriate length to span the lateral width of shade sheets passing through the assembly 16.

The spacer device feeding mechanisms 18 also include means for properly positioning the spacer devices for attachment to the proximate shade sheet and for actuating the piston and cylinder assembly 199 to cut the endless spacer device to proper length. Specifically, as can be seen in FIGS. 4 and 5, each driven shaft 122 is provided with a clutch 200 between the first bevel gear **126*a* mounted thereon and the driven bevel gear 138. Accordingly, the supply of motive power through the power train from motor 140 to the driven shaft 122 is controlled by the clutch. At its opposite end, the driven shaft is provided with a brake unit 202 mounted on a support fixed with respect to the tray 82. Accordingly, engagement of the clutch and disengagement of the brake permits a spacer device to be fed through the feeding mechanism 18. Conversely, disengagement of the clutch and engagement of the brake stops feeding of the spacer device through the feeding mechanism 18**.

Control of the clutch and brake is through suitable optical sensor devices shown in FIGS. 6 and 8 and indicated diagrammatically in FIGS. 4 and 5 at 204 and 206. (Sensor 204 is shown in phantom lines in FIG. 4 for clarity.).The sensor 204 is encountered first by a leading edge of a spacer device fed through the mechanism 18 and generates a signal that actuates the piston and cylinder assembly 199 to cut the device D to appropriate length. The spool for the spacer device supply may also be equipped with a brake unit to stop its rotation shortly after the cutting operation and after the new leading edge of the device D has entered the feeding mechanism. The second sensor 206, mounted downstream of the first sensor 204, generates a control signal that disengages the clutch and engages the brake to stop feed of the spacer device D in position for attachment to the proximate shade.

The sensors 204 and 206 may be positioned along the path of feed of spacer devices so that spacer devices of various length may be prepared and properly positioned for attachment to shade sheets of various lateral widths. More particularly, as shown in FIGS. 6 and 8, each sensor 204 (description of which will serve to describe sensor 206) is mounted in a tab 201 that depends from a slide plate 203 mounted for lateral sliding movement on the tops of front and back walls 84 and 88 of the tray 82. As can be seen in FIG. 6, the sensor is positioned to "see" the spacer device D as it passes through the mechanism 18.

While optical sensors are described with reference to the preferred embodiments, it is to be understood that other types of sensors such as physical sensors may be used in this application.

D. The Mechanisms for Attaching Spacer Devices to Proximate Shade Sheets

Once a spacer device has been prepared by being cut to proper length and has been fed to proper position for attachment to its proximate shade sheet, it is attached to that sheet by an attaching device 20. As shown in FIGS. 2 and 3, each attaching device comprises, for each sheet, a pair of mutually parallel, elongate heat welding bars 210 and 212 which cooperate to heat weld spacer devices to sheets. The lower most 210 bar of each pair comprises a cushioned backup or pressure bar which is covered by a flexible, non-stick covering 216 held in place by two clamp rails 218. The upper bar 212 of each pair comprises a solid metal body 220 through which an electrical resistance wire 222 passes in contact with the body 220. The solid body 220 is similarly covered with a non-stick covering 224 held in place by clamp rails 226. It will be understood that the back-up bar of one pair and the upper heat applying bar of an adjacent pair may, in fact, be formed of a single structural piece of metal as shown in the Figures. For convenience, however, the respective bars will be described as separate components.

After the welding operation, the heat applying bar is cooled by water circulated through conduits 227 to prevent overheating and to permit the weld to set.

As can be seen in FIGS. 2 and 3, the heat welding bars, which are mounted on the forward end of pivot arms 130, may be pivoted by actuation of the piston and cylinder assembly 134 between a closed clamping position shown in FIG. 2 and an open spaced-apart position shown in FIG. 3.

Thus, shade sheets fed through the sheet feeding assembly 16 and arcuate spacer devices fed by the spacer feeding mechanisms 18 are heat sealed together by the movement of the pivot arms to the closed position shown in FIG. 2. More particularly, the spacer devices are fed laterally across shade sheets when the pivot arms are in the open position shown in FIG. 3. When spacer devices are properly positioned by all of the four spacer device feeding mechanisms 18 and shade sheets are respectively in close proximity thereto, the pivot arms are moved to their closed position by actuation of the piston and cylinder assembly 134 thereby clamping the free edge of each spacer device to the closely proximate shade sheet. Each upper heat welding bar is then heated by the electrical resistance heating wire to heat weld the edge of the spacer device to the proximate shade sheet. Thereafter, the pivot arms may be moved to the open position to permit advance of the shade sheets through the apparatus.

As can be seen in FIGS. 2 and 3 and as mentioned above, advance of the shade sheets by driving of the nip rollers 66 and 68 over the outlet idler rollers 62 causes the shade sheets with spacer devices attached thereto to be compressed together. Further, the arrangement of the outlet idler rollers each causing the sheet which it guides to pass between the nip rollers and the heat welding bars associated therewith over a path of length different than the path defined by an adjacent outlet idler roller causes each spacer device to be longitudinally displaced with respect to the spacer device mounted at the same time on an immediately adjacent sheet. More particularly, all heat welding bars are mounted on the pivot arms 130 to define a plane when the bars are in the closed position (see FIG. 2) that extends generally perpendicularly to each of the shade sheets as fed by the sheet feeding assembly 16 and to the base 47. Each sheet is thereafter guided between its associated heat welding bars and the nip rollers over a path of length longer than that for the one adjacent sheet and shorter than that for an opposite adjacent sheet.

E. The Mechanism for Laterally Cutting all Shade Sheets Simultaneously

Figure 11:
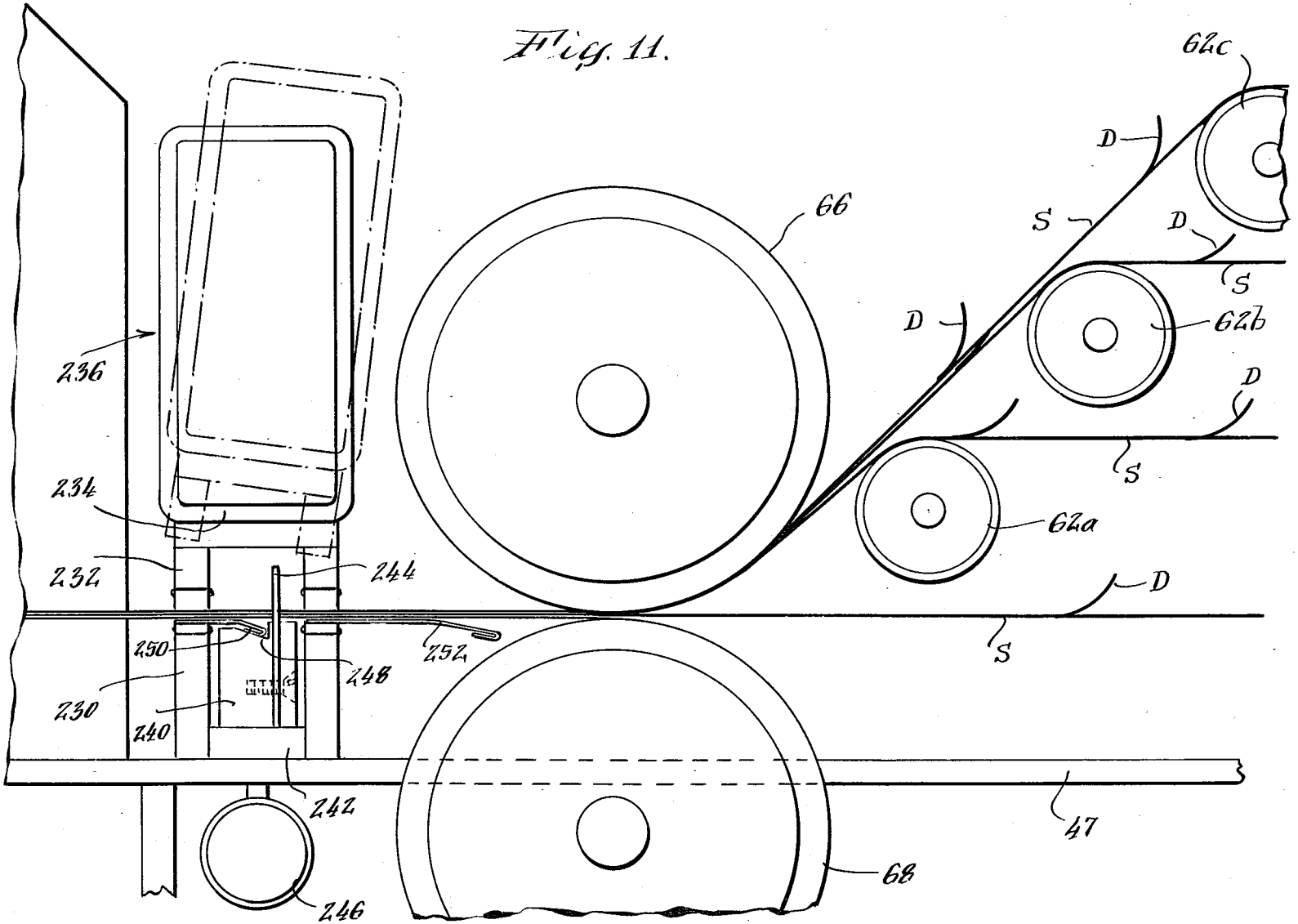
FIG. 11 is an enlarged side elevational view of a portion of the apparatus for compressing shade sheets and spacer devices attached thereto together and for laterally cutting the shade sheets.

Referring now to FIG. 11, apparatus for laterally simultaneously cutting all of the shade sheets after compression between the nip rollers 66 and 68 includes a lower U-shaped, longitudinally extending channel 230 mounted on the support base 47 carried on support beams 46. (It will be understood that the base 47 for each component of the apparatus may be a separate structure from the base for any other component.) An inverted U-shaped channel 232 is mounted for pivoted movement toward and away from the lower channel with the legs thereof in mutually confronting relation. More particularly, the upper inverted channel is mounted on the lower wall 234 of a box beam 236 that is in turn mounted for pivoted movement at the end of a pivot bracket 238 (see FIG. 1). The bracket is mounted for pivoted movement about pins (not shown) secured to braces (not shown) mounted with the intermediate vertical beams 48. A double acting fluid driven piston and cylinder assembly 249 is linked between the L-shaped beam 76 and the bracket 238 to reciprocate the upper channel.

A shuttle 240 is mounted for lateral reciprocal movement within the lower channel 230 on an anti-friction block 242 which, for example, may be made of nylon. A blade 244 having a generally inverted V-shaped in side elevation is secured to one edge of the shuttle 240 and has opposing laterally directed cutting edges that project from the shuttle into the plane defined by the sheets. A double acting piston and cylinder assembly 246 is mounted below the base 47 and is connected to both sides of the shuttle 240 by a cable guided over opposite pulleys (not shown). Accordingly, actuation of the piston within the cylinder in one lateral direction causes the shuttle to move in an opposite lateral direction. Reversal of movement of the piston causes similar reversal of movement of the shuttle. Since the blade has opposing cutting edges, the shade sheets may be cut by movement of the shuttle in either direction.

The cutting operation is performed by clamping of all shade sheets together between the opposing confronting legs of the upper and lower U-shaped channels 230 and 232 by action of the piston and cylinder assembly 249. Since the assembly 249 is double acting, it can power the upper channel to its upward position. When deactivated, the piston and cylinder assembly allows the upper channel to fall by gravity to its closed position. However, when the piston and cylinder is actuated in the opposite direction it forces the U-shaped channels tightly together for subsequent cutting of clamped sheets by the blade 244.

The operation of the upper clamping channel is controlled to insure safe operation of the shuttle. Specifically, two sensors such as limit switches are mounted on the base 47 at one end thereof. The first is designed to sense when the upper clamping channel has dropped as fully as possible under the influence of gravity to its closed position. If an obstruction, such as a foreign object, is between the confronting legs of the opposing U-shaped channels 230 and 232, this sensor is not closed. Only when this first sensor is closed may the piston and cylinder assembly be actuated to further tightly clamp the upper channel to the lower channel, tripping the second sensor. This additional tight clamping assures that the shuttle is effectively shielded from an operator and only when the second sensor is closed indicating that the upper clamping channel has been tightly clamped to the lower channel, may the shuttle be reciprocated. A third sensor is mounted on the opposite end or side of the base to detect when the upper channel is tightly clamped to the lower channel for reciprocation of the shuttle in the opposite direction.

As can be seen in FIG. 11, the upper surface of the shuttle 240 is provided with a V-shaped groove 248. A guide plate 250 is secured to the forward most leg of the lower channel 230 and fits in the groove 248 in the shuttle. This guide ensures that the shade sheets and spacers, after being laterally cut, can exit from the cutting mechanism. A similar guide 252 is mounted on the upper surface of the rear most leg of the lower channel 230 and projects rearwardly therefrom to guide the shade sheets into the cutting mechanism from the nip rollers 68 and 66.

F. The Mechanisms for Trimming the Longitudinal Edges of the Shade Sheets and Spacer Devices.

Figure 12:
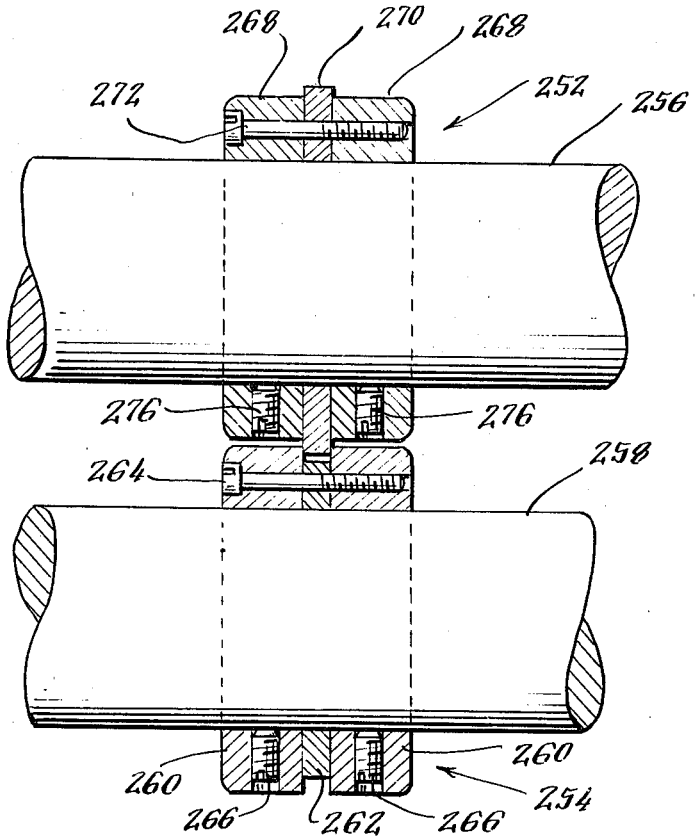
FIG. 12 is a front elevational view of the trimming mechanism for trimming the edges of assembled shade sheets to provide a shade device of desired width.

Now referring to FIG. 12, side trimming mechanisms 24 are provided to laterally size the shade sheets and spacer devices by trimming the longitudinal edges thereof. FIG. 12 illustrates one such mechanism which includes upper and lower trimmer discs 252 and 254, respectively, mounted on driven shafts 256 and 258, respectively, that extend with their axes parallel to those of nip rollers 66 and 68 at a location downstream of the sheet cutting mechanism 23 (see FIG. 1). The lower trimmer disc comprises two outer rollers 260 between which is clamped a reduced diameter circular plate 262. The outer rollers are held together by laterally extending machine screws 264 and the whole assembly may be positioned laterally on the lower shaft 258 by set screws 266. The upper trimmer disc includes two outer rollers 268 and an upper cutting plate 270 of enlarged diameter clamped between the rollers by means of machine screws 272. The upper roller may also be positioned laterally on the upper shaft by set screws 276. Accordingly, it will be appreciated that the trimmer discs may be adjusted laterally to trim the shade sheets and spacer to any desired lateral dimension. The shafts are mounted so that the upper circular plate 270 projects into the recess formed between the lower roller 260 by the spacing of the reduced diameter plate 262. The edges of upper cutting plate 270 act in combination with the side surfaces of the lower rollers 260 in a scissors fashion to perform the trimming operation.

G. The Mechanism for Attaching all Shade Sheets to a Roller.

Figure 14:
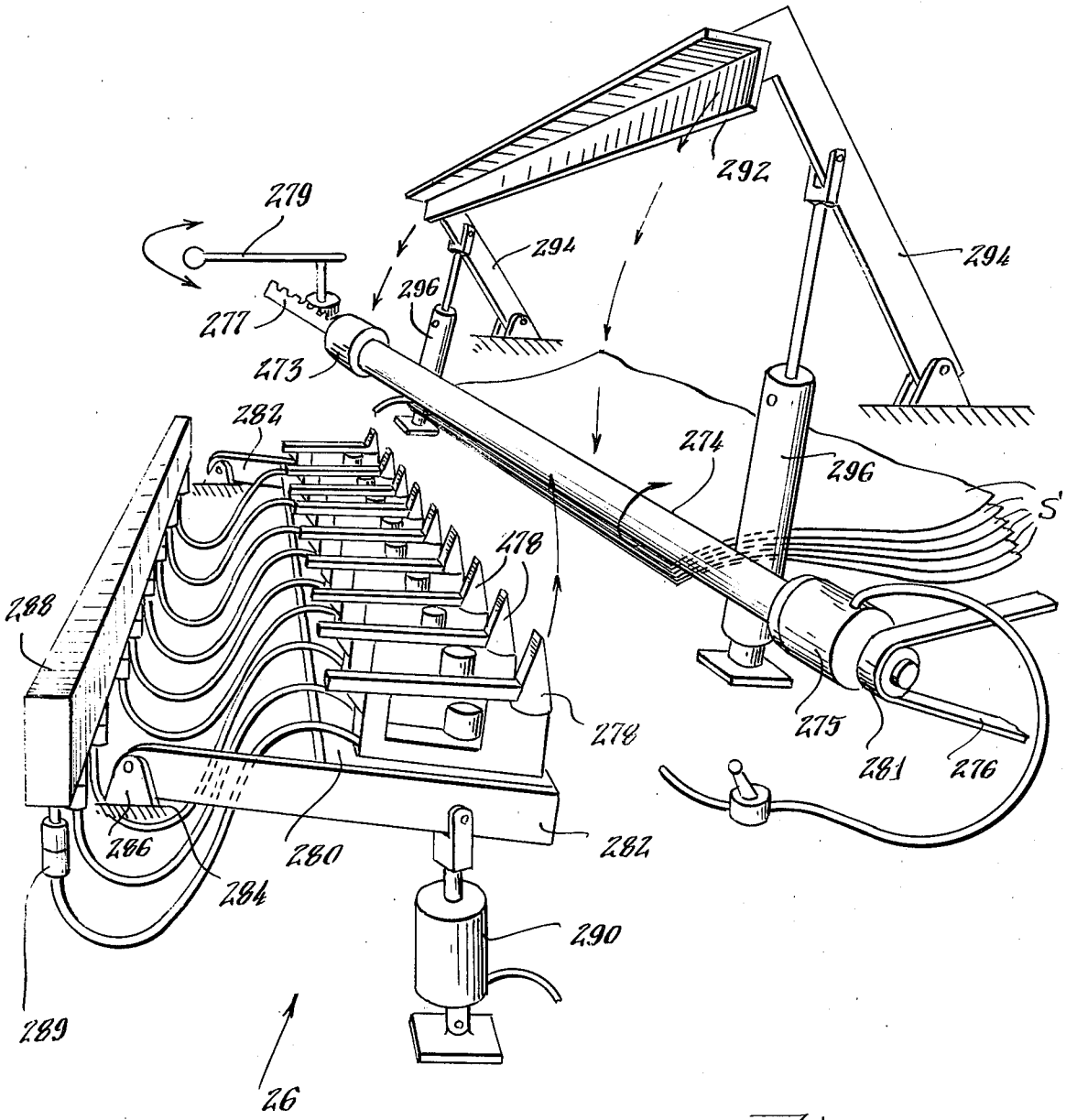
FIG. 14 is a perspective view of apparatus for securing a leading lateral edge of each of the shade sheets to a retracting roller and for retracting the sheets thereon.

Referring now to FIG. 14, leading lateral edges of all shade sheets, previously cut by the lateral cutting mechanism 23, are attached to a solid roller 274 made, for example, of wood by an attaching mechanism generally shown at 26. The roller is held between two clamps 273 and 275, one 273 of which is mounted on a rack gear 277 for lateral reciprocal movement. The rack is moved to reciprocate clamp 273 by means of a lever 279. Electric motor 78 (FIG. 1) is operable through a belt 276 and gearing system (not shown in FIG. 1) to rotate the roller 274 to retract shade sheets and spacer devices thereon. A slip-clutch unit 281 is provided to selectively control supply of rotary power to the clamp 275 for rotating roller 274.

The leading lateral edge of the sheets are attached to the roller by staples driven through the sheets into the roller by a gang of stapler devices. The stapler devices 278 are mounted on a support platform 280 carried for reciprocal movement at the ends of pivot arms 282. The arms are pivoted about pins 284 carried in brackets 286 mounted on a support (structure not shown) carried on the frame structure 28. The stapler devices are air driven and are connected to a manifold 288 through quick disconnect couplings 289 so that the number of devices to be operated may be easily selected. The pivot arms are driven upwardly to move the staplers into operative position to the roller by single acting piston and cylinder assemblies 290.

The roller is braced for the attaching operation by an inverted V-shaped rail 292 carried for reciprocal movement on arms 294 pivoted on a structure (not shown) supported on the frame structure 28 and actuated by single acting piston and cylinder assemblies 296. The V-shaped rail is also a safety guard for the spacer devices when a roller is not in position between clamps 273 and 275. Accordingly, it will be appreciated that the leading lateral edges of the shades are moved into close proximity to the roller. Thereafter, the rail 292 is lowered into engagement with the upper surface of the roller 274 to align and brace it for the stapling operation. Then, the stapler devices 278 are actuated by being moved into operative position with the sheets and rollers by actuation of the piston and cylinder assemblies 290. Sensors are provided to ensure that the rail 292 is in the closed position before the stapler devices fire.

After the stapler devices have been actuated and the shade sheets and spacer devices rolled on the roller, the clamp 275 is opened and the shade device is removed for other operations.

H. Alternative Embodiments

While one preferred embodiment of the invention has been described above in detail, other specific forms of the various mechanisms described above in detail may be used to achieve mass production economies in the manufacture of insulating shade devices. Such other exemplary embodiments are shown in FIGS. 15, 16 and 17.

Figure 15:
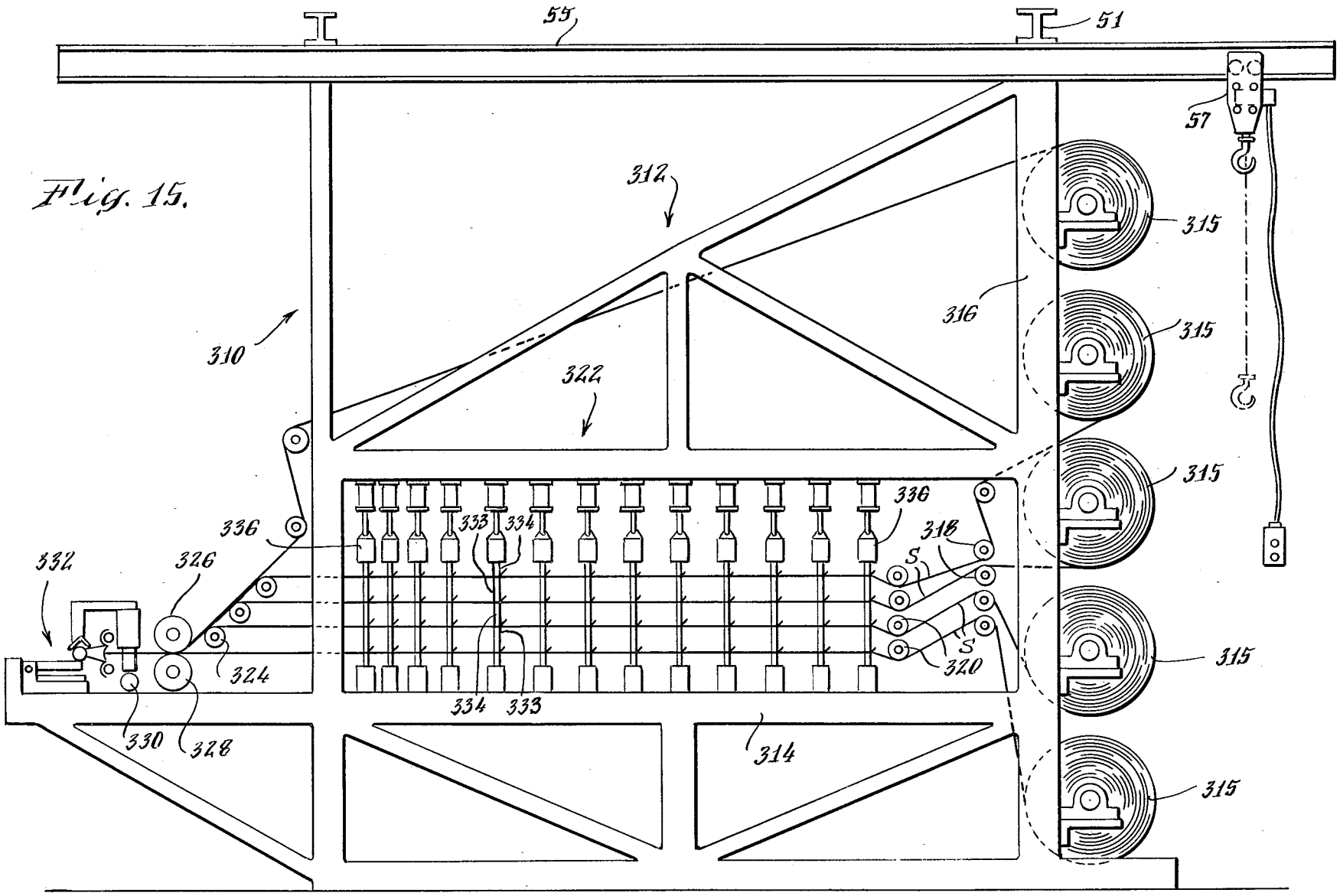
FIG. 15 is a side elevational view of a second embodiment of the present invention.

Referring first to FIG. 15, an alternative embodiment is shown which incorporates many of the same mechanisms described in detail above. In particular, this alternative generally indicated at 310 includes a frame structure generally indicated at 312 having a platform 314 similar to that described with reference to the first embodiment. Supplies 315 of sheet material are stored in a vertical arrangement on the rear vertically extending beams 316 of the frame structure. Each sheet is guided over an idler roller 318 and a spreader roller 320 through a stage generally indicated at 322 for attaching spacer devices to each. Each shade is then guided over an outlet idler roller 324 through nip rollers 326 and 328 through a lateral cutting mechanism 330 and a sheet attachment mechanism 332. Only the arrangement for attaching spacer devices to each of the sheets differs from the comparable mechanism of the first embodiment. In the second embodiment, as will be appreciated from FIG. 15, all spacer devices are attached to all sheets simultaneously. The apparatus shown is arranged to attach up to thirteen spacer devices to each shade sheet simultaneously. Of course, provision may be made to attach more devices simultaneously. It will also be understood that less than all attachment mechanisms may be operated if smaller shades are to be made. For each sheet, lateral spacer device feeding mechanisms such as those described above in detail are provided although they are not illustrated in FIG. 15. Pairs of heat welding bars 332 and 334 are provided for each spacer device to be secured to each shade sheet. The heat sealing bars for spacer devices arranged at any one longitudinal location on the shade sheets are linked together by hook and guide arrangements and the upper most heat welding bar is linked to a double acting pressurized fluid driven piston and cylinder assembly 336. This assembly is arranged to compress all heat welding bars together to seal all spacer devices in a vertical array to their closely proximate shade sheets. Conversely, the assembly is arranged to reciprocate the upper most heat welding bar upwardly and through the hook arrangements draw the remaining heat welding bars to be spaced apart to permit spacer devices and sheets to pass therebetween.

The advantage of the assembly shown in FIG. 15 is that an entire shade may be assembled at one time through one simultaneous operation of all heat welding bars. Accordingly, repeated starting and stopping actions of advance of the shade sheets through the apparatus during assembly of one shade is not necessary. That is, the shade sheet advance is stopped once for attachment of all spacer devices thereto simultaneously. Thereafter, the sheets are advanced through the apparatus for final assembly.

Figure 16:
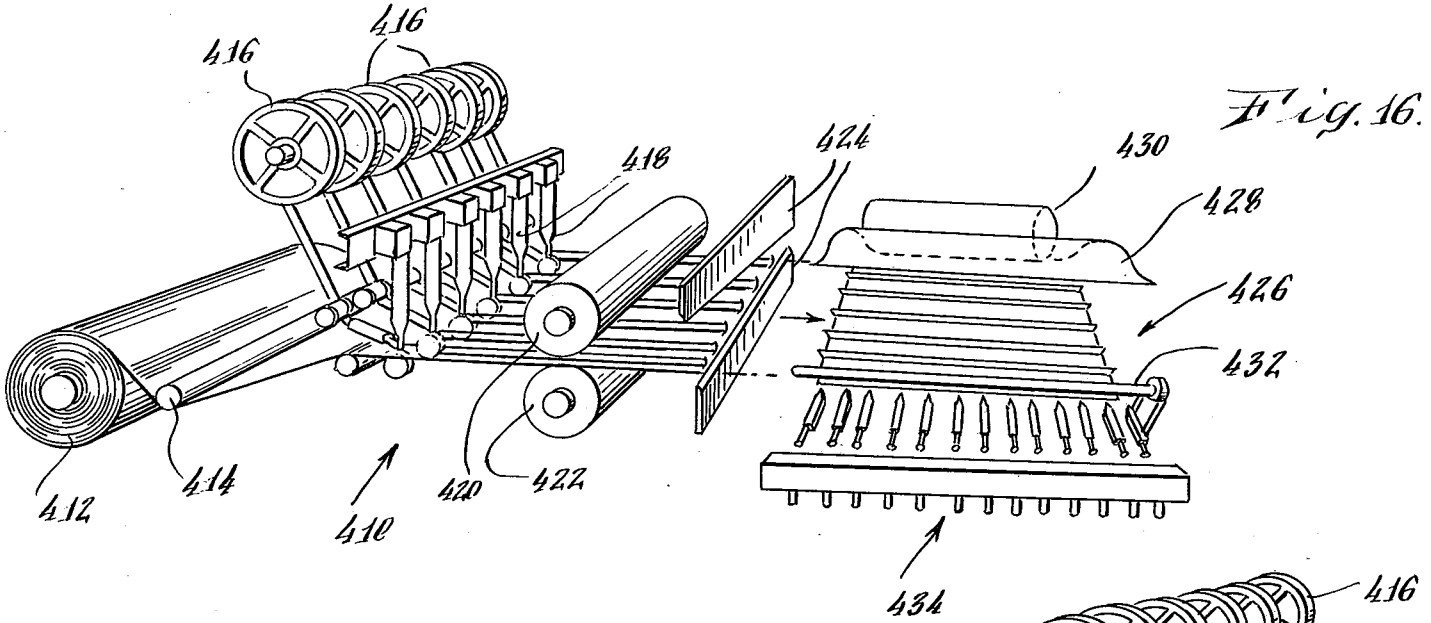
FIG. 16 is a perspective view of a third embodiment of the invention which simultaneously and continuously attaches spacer devices to a single sheet using, for example, ultrasonic welding apparatus.
Figure 17:
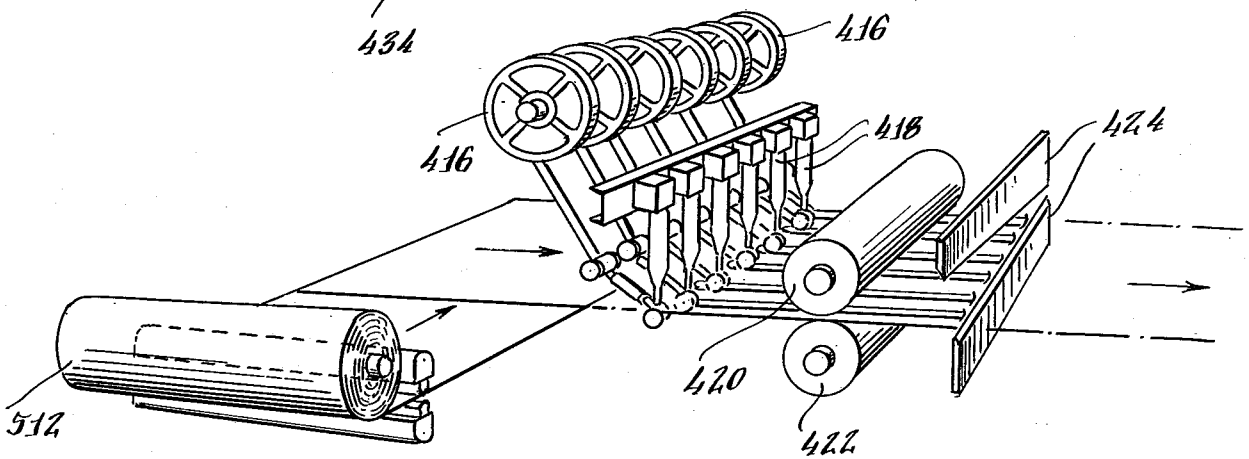
FIG. 17 is a perspective view of a fourth embodiment of the invention that is similar to the third embodiment.

Two other embodiments of apparatus for assembling shade devices are shown in FIGS. 16 and 17. In each of these embodiments, rather than feeding spacer devices laterally across longitudinally advanced shade sheets for attachment thereto, spacer devices and shade sheets are fed in the same direction. In a third embodiment, or second of the latter two alternatives, generally indicated at 410, a shade sheet is advanced from a supply 412 and passed under a spreader roller 414. Simultaneously, a plurality of spacer devices D are fed from supplies 416 in the same direction as is the shade sheet. Each of these spacer devices is advanced at the same rate as is the shade sheet and is attached thereto while moving therewith by a sonic welding horn, each indicated at 418. Advance of the sheets and spacer devices is powered by two nip rolls 420 and 422 which pass the assembled sheet and spacer devices to a cutting mechanism diagrammatically indicated at 424. There, the assembled sheet and spacer devices are cut to a suitable width for the final shade sheet. Shade sheets are repeatedly made in this fashion and are stacked at a station generally indicated at 426 until enough shade sheets are assembled to comprise a finished shade device. An upper shade sheet 428 is fed from a supply 430 in a direction perpendicular to that of advance of the first shade sheet and spacer devices. When this upper sheet and the assembled sheets and spacer devices are appropriately stacked, they are attached to a roller 232 by a gang of staplers generally indicated at 234 identical to that described with reference to the first embodiment.

In this third embodiment, the length of the shade apparatus made from continuous single sheet is limited by the width of the supply roll of shade sheet material that may be acquired. One suggestion for avoiding this limitation is illustrated in FIG. 17. There, the shade sheet is supplied from a supply roll 512 in a direction 90 degrees from that of advance of the sheet through the apparatus for attaching spacer devices thereto. Accordingly, the length of the sheet is determined by the amount of sheet material unwound from the supply roll 512. In other respects, the apparatus of the fourth embodiment is the same as that described with reference to the third embodiment.

It will be appreciated that the several embodiments of the apparatus and the method of the invention described in detail above provide an economical means for mass production of shade apparatus for insulating against radiant, conductive, and convective heat transmission. Therefore, this invention performs an exceptionally desirable function in that it economically brings to market passive energy conservation equipment for easy widespread use.

Although specific embodiments of the present invention have been described above in detail, it is to be understood that this is for purposes of illustration. Modifications may be made to the described apparatus in order to adapt them to particular applications.

What is claimed is:

1. Apparatus for assembling a shade device for insulating a building area such as a window or wall against heat transmission and that includes a roller, a plurality of shade sheets attached to said roller to be retracted thereon and detracted therefrom, and a plurality of spacer devices mounted with one sheet of each pair of adjacent sheets to space them apart when detracted from said roller; said apparatus comprising:

means for placing said sheets generally in mutually parallel spaced relation;

means for feeding spacer devices into close proximity to each of said sheets on which spacer devices are to be mounted;

means for smoothing and laterally stretching each of said sheets on which spacer devices are to be mounted;

means for attaching each said spacer device to its respective closely proximate sheet after said closely proximate sheet has been smoothed and laterally stretched by said smoothing and stretching means;

means for simultaneously advancing said sheets assembled with said spacer devices to said roller;

means for securing a leading lateral edge of each of said sheets to said roller; and means for rotating said roller to retract said sheets and said spacer devices thereon.

2. Apparatus for assembling a shade device for insulating a building area such as a window or wall against heat transmission and that includes a roller, a plurality of shade sheets attached to said roller to be retracted thereon and detracted therefrom, and a plurality of spacer devices mounted with one sheet of each pair of adjacent sheets to space them apart when detracted from said roller; said apparatus comprising:

means for feeding each of said sheets in mutually spaced relation;

means for feeding spacer devices laterally across each of said sheets on which spacer devices are to be mounted in close proximity thereto;

means for smoothing and laterally stretching each of said sheets on which spacer devices are to be mounted;

means for attaching each said spacer device to its respective closely proximate sheet after said closely proximate sheet has been smoothed and laterally stretched by said smoothing and stretching means;

means for simultaneously advancing said sheets to said roller;

means for securing a leading lateral edge of each of said sheets to said roller;

means for rotating said roller to retract said sheets and said spacer devices thereon; and means for laterally cutting all of said sheets to define trailing lateral edges spaced from said leading lateral edges.

3. Apparatus for assembling a shade device for insulating a building area such as a window or wall against heat transmission and that includes a roller, a plurality of shade sheets attached to said roller to be retracted thereon and detracted therefrom, and a plurality of spacer devices mounted with one sheet of each pair of adjacent sheets to space them apart when detracted from said roller, each said spacer device comprising an elongate strip of sheet material having a major axis and a normally arcuate cross-sectional shape curved about said major axis; said apparatus comprising:

means for longitudinally feeding each of said sheets;

means for longitudinally feeding all of said spacer devices to be attached to each said sheet on which spacer devices are to be mounted in close proximity thereto;

means for smoothing and laterally stretching each of said sheets on which spacer devices are to be mounted;

means for simultaneously attaching one elongate edge of all of said spacer devices, which is generally parallel to said major axis, to said closely proximate sheet with the opposite elongate edge thereof curved away and thereby spaced from said closely proximate sheet, said attaching means being operative after said closely proximate sheet has been smoothed and stretched by said smoothing and stretching means;

means for assembling all said sheets to which spacer devices have been attached in generally mutually parallel spaced relation;

means for advancing said assembled sheets to said roller;

means for simultaneously securing a leading lateral edge of each of said sheets to said roller; and means for rotating said roller to retract said sheets and said spacer devices thereon.

4. Apparatus for assembling a shade device for insulating a building area such as a window or wall against heat transmission and that includes a roller, a plurality of shade sheets attached to said roller to be retracted thereon and detracted therefrom, and a plurality of spacer devices mounted with one sheet of each pair of adjacent sheets to space them apart when detracted from said roller, each said spacer device comprising an elongate strip of sheet material having a major axis and a normally arcuate cross-sectional shape curved about said major axis; said apparatus comprising:

means for simultaneously, longitudinally feeding said sheets in generally mutually parallel, spaced relation;

means for simultaneously feeding at least one spacer device laterally across each said sheet on which spacer devices are to be mounted in close proximity thereto;

means for smoothing and laterally stretching each of said sheets on which spacer devices are to be mounted;

means for simultaneously attaching one elongate edge of each said spacer device, which is generally parallel to said major axis, to its respective closely proximate sheet with the opposite elongate edge thereof curved away and thereby spaced from said closely proximate sheet, said attaching means being operative after each said closely proximate sheet has been smoothed and stretched by said smoothing and stretching means;

means for simultaneously advancing said sheets to said roller;

means for simultaneously securing a leading lateral edge of each of said sheets to said roller; and means for rotating said roller to retract said sheets and said spacer devices thereon.

5. Apparatus as claimed in claim 4 wherein said means for feeding said sheets comprises:

frame means;

a plurality of inlet guide rollers mounted in spaced, mutually parallel relation on said frame means;

a plurality of outlet guide rollers mounted in spaced mutually parallel relation on said frame means, each of said outlet guide rollers being spaced from and parallel to one of said inlet guide rollers and constituting therewith a guide roller pair for guiding one said shade sheet thereover; and means for moving each said sheet across one guide roller pair.

6. Apparatus according to claim 5, said plurality of inlet guide rollers being mounted with their axes defining a common plane extending generally perpendicularly to each said sheet as guided between one said guide roller pair.

7. Apparatus according to claim 5 or 6, further comprising means for urging all said sheets and said spacer devices attached thereto together after leaving said sheet feeding means, and wherein each of said outlet guide rollers is mounted to guide one of said sheets to said urging means over a path of length longer than that for one adjacent sheet and shorter than that for an opposite adjacent sheet.

8. Apparatus according to claim 5 or 6, said plurality of outlet guide rollers being mounted with their axes defining a common plane extending obliquely to each said sheet as guided between one said guide roller pair, and wherein said means for moving said sheets includes a pair of nip rollers, at least one of which is driven, the nip of which is located in the proximity of one extreme outlet guide roller.

9. Apparatus according to claim 4, further comprising means for laterally cutting all of said sheets to define trailing lateral edges spaced from said leading lateral edge.

10. Apparatus according to claim 4, wherein said means for attaching said spacer devices to said sheets comprises, for each said sheet to which spacer devices are attached, a pair of laterally elongated, mutually parallel rails mounted for relative reciprocal movement between an open position spaced apart from each other permitting said sheet and said spacer devices to pass therebetween and a closed position for clamping said one edge of one said spacer device to said sheet, and attachment mechanism means mounted with at least one rail of each said pair of rails for attaching said one edge of said spacer device to said sheet when clamped thereto.

11. Apparatus according to claim 10, wherein said spacer devices and said sheets comprise heat weldable materials and wherein said attachment mechanism means comprises a heat welding bar mounted with one rail of each said pair of rails and a pressure receiving back-up bar mounted with the other rail of each said pair of rails.

12. Apparatus according to claim 10 or 11, further comprising means for mounting each said pair of rails in generally coplanar relation on a plane extending generally perpendicularly to said sheets when fed between said guide roller pairs and for said reciprocal movement, said mounting means comprising:

frame means;

a plurality of pivot arms, each carrying at one end one rail of one said rail pair and one rail of an adjacent rail pair, and being mounted for pivoted movement at the opposite end on said frame means; and means for simultaneously pivoting said arms between a rest position with each said pair of rails in said closed position and a pivoted position with each said pair of rails in said open position.

13. Apparatus according to claim 12, said means for simultaneously pivoting said arms comprising:

motive means for pivoting one of said arms between said rest position and said pivoted position; and link means separately linking said one arm to each of said other arms.

14. Apparatus according to claim 13, said one arm being an extreme arm and each said link means comprising a link arm extending obliquely from said extreme arm to one of said other arms.

15. Apparatus according to claim 13 or 14, said motive means comprising pressurized-fluid driven actuator means linked between said frame means and said one arm.

16. Apparatus according to claim 4, each said means for feeding said spacer devices comprising:

elongate guide means, mounted in close proximity and extending laterally to the path of feed of one of said sheets, formed with an elongate slot for receiving said opposite elongate edge of said spacer device and exposing said one elongate edge of said spacer device; and drive means for advancing said spacer device laterally along said slot.

17. Apparatus according to claim 16, further comprising antifriction means coated on the surface of said slot for facilitating advancing of each said spacer device therealong.

18. Apparatus according to claim 16, wherein said guide means is formed with an arcuate support surface, a portion of which defines one wall of said slot, said slot having an elongate abutment surface at an extreme of said one wall against which said opposite elongate edge of said spacer device is guided, and wherein said drive means comprises means for pressing said spacer means against said support surface and for urging said opposite elongate edge of said spacer device into abutting engagement with said abutment surface.

19. Apparatus according to claim 18, said pressing and urging means comprising:

at least one drive wheel mounted for rotation with its circumference adjacent said support surface and a lateral diameter thereof, extending in the direction of elongation of said slot, canted slightly inwardly toward the downstream end of said slot; and means for biasing said drive wheel into rotational sliding frictional engagement with said support surface.

20. Apparatus according to claim 19, each said means for feeding said spacer devices further comprising wall means associated with said guide means, a stub shaft journalled for rotation in said wall means and carrying on one end one said drive wheel and wherein said biasing means comprises spring means compressed between said wall means and the end of said stub shaft opposite said one end.

21. Apparatus according to claim 19, said drive means further comprising motor means for driving said drive wheel.

22. Apparatus according to claim 16, further comprising clutch means for rendering said drive means operative and brake means for thereafter stopping said drive means when a spacer device is properly laterally positioned for attachment to said sheet.

23. Apparatus according to claim 16 wherein said spacer devices are fed from supplies and wherein said apparatus comprises means for cutting each said spacer device to proper length after being fed from a supply.

24. Apparatus according to claim 23 further comprising:

clutch means for selectively supplying motive power to said drive means and brake means for braking said drive means to stop advance of a spacer device when supply of motive power thereto is interrupted by said clutch means;

first sensor means for sensing when a length properly constituting one said spacer device has been advanced from a supply and generating a signal to actuate said cutting means; and second sensor means for sensing when said one spacer device is in proper position for attachment to one said sheet and generating a signal to actuate said clutch means and said brake means to stop advance of said spacer device.

25. Apparatus according to claim 24 wherein each said supply of said spacer devices is stored on a reel and wherein said apparatus further comprises reel brake means for stopping rotation of said reel after each said spacer device has been cut in response to said signal generated by said first sensor.

26. Apparatus according to claim 4 further comprising means for urging all said sheets and said spacer devices attached thereto together after said spacer devices are attached thereto and wherein all said spacer device attaching means are mounted in generally coplanar relation on a plane extending generally perpendicularly to said sheets as fed by said sheet feeding means, said spacer device attaching means being simultaneously operable to attach one spacer device to each said sheet at the same longitudinal position in said sheet feeding means and wherein said sheet feeding means further comprises means for guiding each said sheet to said urging means over a path of length longer than that for one adjacent sheet and shorter than that for the opposite adjacent sheet whereby each said spacer device on each sheet is longitudinally displaced from each said spacer device on adjacent sheets when fed to said urging means.

27. Apparatus according to claim 26, wherein said guiding means comprises a plurality of outlet guide rollers each for guiding one said sheet out of said sheet feeding means, said outlet guide rollers being mounted in spaced, mutually parallel, coplanar relation on a plane extending obliquely to said sheets as fed in mutually parallel relation by said sheet feeding means.

28. Apparatus according to claim 4 wherein each said spacer device feeding means is mounted for reciprocal movement toward and away from its closely proximate sheet and comprises:

a plurality of drive wheels each adapted to frictionally engage a spacer device;

a plurality of longitudinally extending stub shafts each carrying one drive wheel for rotation therewith; and a laterally extending driven shaft coupled to each said stud shaft to rotate it;

and wherein said apparatus further comprises power means for simultaneously driving all of said driven shafts and, hence, said drive wheels including:

a motor;

a power shaft driven by said motor and extending transversely between the planes of said sheets as fed by said sheet feeding means; and a plurality of articulated linking shafts each coupling said power shaft to one said driven shaft for transmitting rotary motion thereto.

29. Apparatus according to claim 28, means for mounting all said spacer device feeding means for said reciprocal movement comprising:

frame means;

a plurality of pivot arms, each carrying at one end one said spacer device feeding means and being mounted for pivoted movement at the opposite end on said frame means; and means for simultaneously pivoting said arms between a clamped position with each said spacer device positioned toward its closely proximate sheet and a rest position with each said spacer device reciprocated away from its closely proximate sheet.

30. Apparatus according to claim 29, said means for simultaneously pivoting said arms comprising:

motive means for pivoting one of said arms between said rest position and said pivoted position; and link means separately linking said one arm to each of said other arms.

31. Apparatus according to claim 30, said one arm being an extreme arm and each said link means comprising a link arm extending obliquely from said extreme arm to one of said other arms.

32. Apparatus according to claim 29 or 30, said motive means comprising pressurized-fluid driven actuator means linked between said frame means and said one arm.

33. Apparatus according to claim 4, said means for laterally cutting said sheets comprising:

shuttle means mounted for reciprocal movement laterally with respect to said sheets;

blade means, having opposing laterally directed cutting edges, projecting from said shuttle means into the plane defined by said sheets; and means for reciprocating said shuttle means to draw said blade means through and cut said sheets.

34. Apparatus according to claim 33 further comprising second means for urging said sheets and said spacer devices attached thereto together laterally in a longitudinally extending planar region, frame means defining a U-shaped channel extending laterally adjacent said region and wherein said shuttle means is mounted for said reciprocal lateral movement in said channel and comprises a shuttle, antifriction means for mounting and guiding said shuttle in said channel and wherein said reciprocating means comprises a double-acting pressurized-fluid driven actuator for reciprocating said shuttle in either lateral direction to cut said sheets with either of said cutting edges.

35. Apparatus according to claim 34 wherein said actuator is mounted beneath said channel and wherein said means for laterally cutting said sheets further comprises cable means for linking said actuator to said shuttle and means for guiding said cable means along a nonlinear path between said actuator and said shuttle.

36. Apparatus according to claim 34 wherein said second means for urging said sheets and said spacer devices together comprises clamp means including an inverted U-shaped channel mounted for reciprocal movement between a closed position with the respective legs of said channels in end-to-end abutting relation and an open position reciprocated away from said U-shaped channel.

37. Apparatus according to claim 36, wherein said inverted U-shaped channel is also mounted between a loosely closed position, which results when it is moved to closed position under the influence of gravity, and a tightly closed position, wherein movement of said inverted U-shaped channel to said loosely closed position only occurs in the absence of an obstruction thereto, and wherein said second means for urging said sheets and said spacer devices together further comprises motive means for moving said inverted U-shaped channel from said loosely closed position to said tightly closed position, first sensor and control means for sensing when said inverted U-shaped channel has moved to said loosely closed position and only thereafter permitting actuation of said moving means to move said inverted U-shaped channel to said tightly closed position.

38. Apparatus according to claim 37, further comprising second sensor and control means for sensing movement of said inverted U-shaped channel to said tightly closed position and only thereafter permitting operation of said shuttle means.

39. Apparatus according to claims 33, 34, or 35, said cutting edges of said blade means each extending from said shuttle to make an oblique angle with the plane defined by said sheets.

40. Apparatus according to claim 4, said securing means comprising staple driving means for driving staples through said sheets into said roller to secure said sheets thereto.

41. Apparatus according to claim 40, further comprising means for mounting said staple driving means for reciprocal movement toward and away from said roller.

42. Apparatus according to claim 41 wherein said staple driving means comprises a plurality of staplers and wherein said mounting means comprises a support bracket on which said staplers are mounted, at least one pivot arm, mounted for pivoted movement at one end, said support bracket being mounted at the opposite end thereof.

43. Apparatus according to claim 40, 41 or 42, further comprising means for aligning and bracing said roller along its entire length when staplers are driven through said sheets into said roller.

44. Apparatus according to claim 43, said bracing means comprising a V-shaped brace mounted for reciprocal movement toward and into contact with said roller, on a side thereof opposite that into which staples are driven, and away from said roller.

45. Apparatus according to claim 4, further comprising means for longitudinally trimming the side edges of said sheets.

46. Apparatus according to claim 45, said trimming means comprising a pair of trimming rollers one of which forms a circumferential U-shaped groove and the other of which forms a mating U-shaped ring, the mating side walls of said groove and said ring constituting trimming edges.

47. Apparatus for assembling a shade device for insulating a building area such as a window or wall against heat transmission and that includes a roller, a plurality of shade sheets attached to said roller to be retracted thereon and detracted therefrom, and a plurality of spacer devices associated with one sheet of each pair of adjacent sheets to space them apart when detracted from said roller; said apparatus comprising:

means for simultaneously feeding each of said sheets in mutually spaced relation;

means for simultaneously feeding one said plurality of spacer devices laterally across each of said sheets on which spacer devices are to be mounted in close proximity thereto;

means for smoothing and laterally stretching each of said sheets on which spacer devices are to be mounted;

means for simultaneously attaching each said plurality of spacer devices to its respective closely proximate sheet, said attaching means being operative after said closely proximate sheet has been smoothed and stretched by said smoothing and stretching means;

means for advancing said sheets to said roller;

means for simultaneously securing a leading lateral edge of each of said sheets to said roller;

means for rotating said roller to retract said sheets and said spacer devices thereon; and means for laterally cutting all of said sheets to define trailing lateral edges spaced from said leading lateral edges.

48. A method of making a shade device for insulating a building area such as a window or wall against heat transmission that includes a roller, a plurality of shade sheets attached to said roller to be retracted thereon and detracted therefrom, and a plurality of spacer devices mounted with one sheet of each pair of adjacent sheets to space them apart when detracted from said roller, said method comprising the steps of:

simultaneously feeding each of said sheets in spaced relation;

feeding spacer devices laterally across each of said sheets on which spacer devices are to be mounted in close proximity thereto;

smoothing and laterally stretching each said sheets on which spacer devices are to be mounted;

simultaneously attaching each said spacer device to its respective closely proximate sheet after said smoothing and stretching step;

advancing said sheets and spacer devices to said roller;

securing a leading lateral edge of each said sheet to said roller; and rotating said roller to retract said sheets and said spacer devices thereon.

49. A method for assembling a shade device for insulating a building area such as a window or wall against heat transmission that includes a roller, a plurality of shade sheets attached to said roller to be retracted thereon and detracted therefrom, and a plurality of spacer devices mounted with one sheet of each pair of adjacent sheets to space them apart when detracted from said roller, each said spacer device comprising an elongate strip of sheet material having a major axis and a normally arcuate cross-sectional shape curved about said major axis; said method comprising the steps of:

longitudinally feeding said sheets in generally mutually parallel, spaced relation;

feeding spacer devices laterally across each said sheet on which spacer devices are to be mounted in close proximity thereto;

smoothing and laterally stretching each of said sheets on which spacer devices are to be mounted;

attaching one elongate edge of each said spacer device, which is generally parallel to said major axis, to its respective closely proximate sheet with the opposite elongate edge thereof curved away and thereby spaced from said closely proximate sheet after said smoothing and stretching;

advancing said sheets to said roller;

securing a leading lateral edge of each of said sheets to said roller;

rotating said roller to retract said sheets and said spacer devices thereon; and laterally cutting all of said sheets to define trailing lateral edges spaced from said leading lateral edge.

50. The method according to claim 49, said attaching step comprising heat welding said one edge of each of said spacer devices to said respective closely proximate sheet.

51. The method according to claim 49, said securing step comprising stapling said leading lateral edge of each of said sheets to said roller.

52. The method according to claim 49, said securing step comprising simultaneously stapling all of said leading edges of all of said sheets to said roller.

* * * * *

UNITED STATES PATENT AND TRADEMARK OFFICE

CERTIFICATE OF CORRECTION

PATENT NO. : 4,386,454

DATED : June 7, 1983

INVENTOR(S) : THOMAS P. HOPPER

It is certified that error appears in the above-identified patent and that said Letters Patent is hereby corrected as shown below:

Column 1

Line 68, change "were feed" to --were fed--.

Column 4

Line 37, change "feed" to --fed--.

Column 11

Line 28, change "inter" to --inter- --.

Column 12

Line 55, "change "lower most" to --lowermost--.

Column 14

Line 60, change "forward most" to --forwardmost--.

Column 16

Line 58, change "upper" to --upper- --.

Column 24, line 31
(Claim 43, line 3)

Change "staplers" to --staples--.

Column 25, line 22
Claim 48, line 14

Change "each" to --each of--.

UNITED STATES PATENT AND TRADEMARK OFFICE

CERTIFICATE OF CORRECTION

PATENT NO. : 4,386,454 Page 2 of 2

DATED : June 7, 1983

INVENTOR(S) : THOMAS P. HOPPER

It is certified that error appears in the above-identified patent and that said Letters Patent is hereby corrected as shown below:

Column 26, line 18
(Claim 49, line 24)

After "stretching" insert --step--.

Change the Title to read:

--APPARATUS FOR ASSEMBLING A SHADE DEVICE FOR INSULATING A BUILDING AREA--.

Signed and Sealed this

*Twenty-seventh* Day of *March 1984*

[SEAL]

*Attest:*

GERALD J. MOSSINGHOFF

*Attesting Officer* *Commissioner of Patents and Trademarks*